US011823607B2

(12) United States Patent
Lee et al.

(10) Patent No.: US 11,823,607 B2
(45) Date of Patent: Nov. 21, 2023

(54) DRIVING CONTROLLER, DISPLAY DEVICE HAVING THE SAME, AND DRIVING METHOD OF DISPLAY DEVICE

(71) Applicant: Samsung Display Co., Ltd., Yongin-si (KR)

(72) Inventors: Hyojin Lee, Yongin-si (KR); Sehyuk Park, Seongnam-si (KR); Eunho Lee, Suwon-si (KR); Jinyoung Roh, Hwaseong-si (KR); Hui Nam, Suwon-si (KR); Bong-Hyun You, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/740,290

(22) Filed: May 9, 2022

(65) Prior Publication Data

US 2022/0343826 A1 Oct. 27, 2022

Related U.S. Application Data

(62) Division of application No. 16/717,907, filed on Dec. 17, 2019, now Pat. No. 11,328,649.

(30) Foreign Application Priority Data

Dec. 19, 2018 (KR) ..... 10-2018-0165415

(51) Int. Cl.
*G09G 3/3225* (2016.01)
*G09G 3/20* (2006.01)

(52) U.S. Cl.
CPC ..... *G09G 3/2007* (2013.01); *G09G 3/3225* (2013.01); *G09G 2320/0247* (2013.01); *G09G 2330/021* (2013.01)

(58) Field of Classification Search
CPC ..... G09G 2320/0247; G09G 2330/021; G09G 3/2007; Y10S 348/91; H04N 5/2357
See application file for complete search history.

(56) References Cited

U.S. PATENT DOCUMENTS 9,548,016 B2 1/2017 Lee et al.
9,875,681 B2 1/2018 Lee et al.
(Continued)

FOREIGN PATENT DOCUMENTS

JP 2014211535 11/2014
KR 10-2013-0087927 8/2013
(Continued)

OTHER PUBLICATIONS

Non-Final Office Action dated Oct. 29, 202, in U.S. Appl. No. 16/717,907.
(Continued)

*Primary Examiner* — Yuzhen Shen
(74) *Attorney, Agent, or Firm* — H.C. Park & Associates, PLC

(57) ABSTRACT

A driving controller of a display device, the controller including a segment divider configured to divide the image signal into a plurality of segments and define a predetermined number of adjacent segments among the plurality of segments as a segment block, an image signal adder configured to add up a gray scale value of the image signal of each of the predetermined number of adjacent segments and output the added-up gray scale values, an average gray scale calculator configured to receive the added-up gray scale values and output an average gray scale value, a correction circuit configured to output corrected added-up gray scale values obtained by adding a weight value to each of the added-up gray scale values on the basis of the average gray scale value, and a driving frequency determiner configured
(Continued)

to determine the driving frequency of the display device on the basis of the corrected added-up gray scale values.

12 Claims, 19 Drawing Sheets

(56) References Cited

U.S. PATENT DOCUMENTS

| | | | | |
|---|---|---|---|---|
| 9,984,623 | B2 | 5/2018 | An et al. | |
| 10,262,569 | B2 | 4/2019 | Watanabe et al. | |
| 2013/0194494 | A1 | 8/2013 | Chun et al. | |
| 2015/0228216 | A1* | 8/2015 | Lee | G09G 3/20 345/691 |
| 2016/0035260 | A1* | 2/2016 | Kim | G09G 3/3614 345/212 |
| 2016/0078798 | A1 | 3/2016 | Watanabe et al. | |
| 2017/0132964 | A1* | 5/2017 | Lee | G09G 3/2029 |
| 2018/0374437 | A1 | 12/2018 | Tomizawa et al. | |
| 2019/0287471 | A1 | 9/2019 | Tomizawa | |
| 2020/0252536 | A1* | 8/2020 | Nishikawa | G01J 1/44 |

FOREIGN PATENT DOCUMENTS

| | | |
|---|---|---|
| KR | 10-2015-0094881 | 8/2015 |
| KR | 10-2016-0011818 | 2/2016 |
| KR | 10-2017-0036934 | 4/2017 |
| KR | 10-2017-0078432 | 7/2017 |
| KR | 10-2017-00098641 | 8/2017 |

OTHER PUBLICATIONS

Notice of Allowance dated Feb. 24, 2021, in U.S. Appl. No. 16/717,907.
Notice of Allowance dated Aug. 20, 2021, in U.S. Appl. No. 16/717,907.
Notice of Allowance dated Jan. 12, 2022, in U.S. Appl. No. 16/717,907.

* cited by examiner

DRIVING CONTROLLER, DISPLAY DEVICE HAVING THE SAME, AND DRIVING METHOD OF DISPLAY DEVICE

CROSS-REFERENCE TO RELATED APPLICATION

This application is a Divisional of U.S. patent application Ser. No. 16/717,907, filed on Dec. 17, 2019, which claims priority from and the benefit of Korean Patent Application No. 10-2018-0165415, filed on Dec. 19, 2018, each of which is hereby incorporated by reference for all purposes as if fully set forth herein.

BACKGROUND

Field

Exemplary embodiments of the present invention relate to a display device, and more specifically, to a display device including a driving circuit having low power consumption.

Discussion of the Background

Among display devices, an organic light emitting display device displays an image using an organic light emitting diode which generates light by recombination of electrons and holes. Some advantages of organic light emitting display devices are a fast response speed and low power consumption.

An organic light emitting display device is provided with pixels connected to data lines and scan lines. The pixels each usually include an organic light emitting diode and a circuit unit for controlling the amount of current flowing into the organic light emitting diode. The circuit unit controls the amount of current flowing from a first driving voltage to a second driving voltage via the organic light emitting diode in response to a data signal. At this time, in correspondence to the amount of the current flowing through the organic light emitting diode, light with a predetermined luminance is generated.

Typically, the transistors included in the circuit unit have been transistors having a low-temperature polycrystalline silicon (LTPS) layer. LTPS transistors have advantages in terms of high mobility and device stability. However, when the voltage level of the second driving voltage is lowered or the operation frequency thereof is lowered, leakage current is generated. When there is leakage current in a circuit unit of a pixel, the amount of current flowing through an organic light emitting diode is changed, so that display quality may be deteriorated.

Recently, in order to reduce leakage current of a transistor included in a circuit unit, studies regarding transistors having an oxide semiconductor as a semiconductor layer are being conducted. Furthermore, studies regarding the use of an LTPS semiconductor transistor and an oxide semiconductor transistor in a circuit unit of one pixel are being conducted.

The above information disclosed in this Background section is only for understanding of the background of the inventive concepts, and, therefore, it may contain information that does not constitute prior art.

SUMMARY

Exemplary embodiments of the present invention provide a driving circuit having reduced power consumption and a display device including the same.

Exemplary embodiments of the present invention also provide a method for driving a display device, the method capable of reducing power consumption.

Additional features of the inventive concepts will be set forth in the description which follows, and in part will be apparent from the description, or may be learned by practice of the inventive concepts.

An exemplary embodiment of the present invention provides a driving controller including a still image determination circuit configured to determine whether an image signal is a still image, and a driving frequency determination circuit configured to determine a driving frequency when the image signal is the still image. The driving frequency determination circuit includes a segment divider configured to divide the image signal into a plurality of segments and define a predetermined number of adjacent segments among the plurality of segments as a segment block, an image signal adder configured to add up a gray scale value of the image signal of each of the predetermined number of segments and output the added-up gray scale values, an average gray scale calculator configured to receive the added-up gray scale values and output an average gray scale value, a correction circuit configured to output corrected added-up gray scale values obtained by adding a weight value to each of the added-up gray scale values on the basis of the average gray scale value, and a driving frequency determiner configured to determine the driving frequency on the basis of the corrected added-up gray scale values.

The correction circuit may output the corrected added-up gray scale value obtained by adding a weight value corresponding to a difference between the added-up gray scale value and the average gray scale value to the added-up gray scale value.

The correction circuit may set the weight value such that the corrected added-up gray scale value becomes greater when the added-up gray scale value is less than the average gray scale value.

The driving frequency determiner may determine, as the driving frequency, a frequency corresponding to the lowest corrected added-up gray scale value among the corrected added-up gray scale values of each of the predetermined number of segments.

The driving frequency determiner may set the driving frequency to a normal frequency level when the image signal is not the still image.

The driving frequency determiner may determine a frequency lower than the normal frequency level as the driving frequency when the lowest corrected added-up gray scale value among the corrected added-up gray scale values of each of the predetermined number of adjacent segments is greater than a predetermined value.

The segment block may include x number of segments adjacent in a first direction and y number of segments adjacent in a second direction (x and y are each a natural number).

Each of the plurality of segments may include the image signal corresponding to "a" number of pixels adjacent to the first direction and "b" number of pixels adjacent in the second direction.

The image signal may include a red image signal, a green image signal, and a blue image signal, and the driving controller may further include an image conversion circuit configured to convert the image signal to an image data signal including a red data signal, a green data signal, a blue data signal, and a white data signal is further included.

The image signal may include a red image signal, a green image signal, and a blue image signal, and the driving controller may further include an image conversion circuit configured to convert the image signal to an image data signal including a red data signal, a first green data signal, a blue data signal, and a second green data signal is further included.

Another exemplary embodiment of the present invention provides a driving controller including a still image determination circuit configured to determine whether an image signal is a still image, and a driving frequency determination circuit configured to determine a driving frequency when the image signal is the still image.

In this embodiment, the driving frequency determination circuit includes a segment divider configured to divide the image signal into a plurality of segments and define a predetermined number of adjacent segments among the plurality of segments as a segment block, a segment flicker calculator configured to calculate a flicker level of each of the predetermined number of adjacent segments and output segment flicker signals, an average flicker calculator configured to receive the segment flicker signals and output an average flicker signal, a correction circuit configured to output corrected segment flicker signals obtained by adding a weight value to each of the segment flicker signals on the basis of the average flicker signal, and a driving frequency determiner configured to determine the driving frequency on the basis of the corrected segment flicker signals.

The correction circuit may output the corrected segment flicker signals obtained by adding a weight value corresponding to a difference between the segment flicker signals and the average flicker signal to the segment flicker signals.

The correction circuit may set the weight value such that a flicker level of the corrected segment flicker signal becomes lower when the segment flicker signal is higher than the average flicker signal.

The driving frequency determiner may determine, as the driving frequency, a frequency corresponding to the highest level of corrected segment flicker signal among the corrected segment flicker signals of each of the predetermined number of adjacent segments.

The driving frequency determiner may set the driving frequency to a normal frequency level when the image signal is not the still image.

Another exemplary embodiment of the present invention provides a display device including a display panel including a plurality of pixels connected to a plurality of data lines and a plurality of scan lines, respectively, a driving controller configured to receive an image signal and output an image data signal, a data control signal, and a scan control signal, a data driving circuit configured to drive the plurality of data lines in response to the image data signal and the data control signal, and a scan driving circuit configured to drive the plurality of scan lines in response to the scan control signal. The driving controller includes a still image determination circuit configured to determine whether the image signal is a still image, and a driving frequency determination circuit configured to determine a driving frequency of the data control signal and the scan control signal when the image signal is the still image. The driving frequency determination circuit includes a segment divider configured to divide the image signal into a plurality of segments and define a predetermined number of adjacent segments among the plurality of segments as a segment block, an image signal adder configured to add up a gray scale value of the image signal of each of the predetermined number of adjacent segments and output the added-up gray scale values, an average gray scale calculator configured to receive the added-up gray scale values and output an average gray scale value, a correction circuit configured to output corrected added-up gray scale values obtained by adding a weight value to each of the added-up gray scale values on the basis of the average gray scale value, and a driving frequency determiner configured to determine the driving frequency on the basis of the corrected added-up gray scale values.

At least one of the plurality of pixels may include a light emitting diode including an anode and a cathode, a first transistor including a first electrode receiving a first driving voltage, a second electrode electrically connected to the anode of the light emitting diode, and a gate electrode, a second transistor including a first electrode connected to a corresponding data line among the plurality of data lines, and a gate electrode connected to the first electrode of the first transistor and receiving a first scan signal, and a third transistor including a first electrode connected to the second electrode of the first transistor, a second electrode connected to the gate electrode of the second transistor, and a gate electrode connected to a second scan signal.

The first transistor and the second transistor may be each a P-type transistor and the third transistor is an N-type transistor.

The first transistor and the second transistor may be each an LTPS semiconductor transistor and the third transistor is an oxide semiconductor transistor.

Another exemplary embodiment of the present invention provides a display device including a display panel including a plurality of pixels connected to a plurality of data lines and a plurality of scan lines, respectively, a driving controller configured to receive an image signal and output an image data signal, a data control signal, and a scan control signal, a data driving circuit configured to drive the plurality of data lines in response to the image data signal and the data control signal, and a scan driving circuit configured to drive the plurality of scan lines in response to the scan control signal. The driving controller includes a still image determination circuit configured to determine whether the image signal is a still image, and a driving frequency determination circuit configured to determine a driving frequency of the data control signal and the scan control signal when the image signal is the still image. The driving frequency determination circuit includes a segment divider configured to divide the image signal into a plurality of segments and define a predetermined number of adjacent segments among the plurality of segments as a segment block, a segment flicker calculator configured to calculate a flicker level of each of the predetermined number of adjacent segments and output segment flicker signals, an average flicker calculator configured to receive the segment flicker signals and output an average flicker signal, a correction circuit configured to output corrected segment flicker signals obtained by adding a weight value to each of the segment flicker signals on the basis of the average flicker signal, and a driving frequency determiner configured to determine the driving frequency on the basis of the corrected segment flicker signals.

Another exemplary embodiment of the present invention provides a method for driving a display device including: determining whether an image signal is a still image; when the image signal is the still image, dividing the image signal into a plurality of segments and defining a predetermined number of adjacent segments among the plurality of segments as a segment block; adding up a gray scale value of the image signal of each of the predetermined number of adjacent segments and outputting the added-up gray scale values; calculating an average gray scale value for the added-up gray scale values; outputting corrected added-up gray scale values obtained by adding a weight value to each of the added-up gray scale values on the basis of the average gray scale value; and determining a driving frequency of the display device on the basis of the corrected added-up gray scale values.

Another exemplary embodiment of the present invention provides a method for driving a display device including: determining whether an image signal is a still image; when the image signal is the still image, dividing the image signal into a plurality of segments and defining a predetermined number of adjacent segments among the plurality of segments as a segment block; calculating a flicker level of each of the predetermined number of adjacent segments and outputting segment flicker signals; calculating an average flicker level for the segment flicker signals and outputting an average flicker signal; outputting corrected segment flicker signals obtained by adding a weight value to each of the segment flicker signals on the basis of the average flicker signal; and determining a driving frequency of the display device on the basis of the corrected segment flicker signals.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
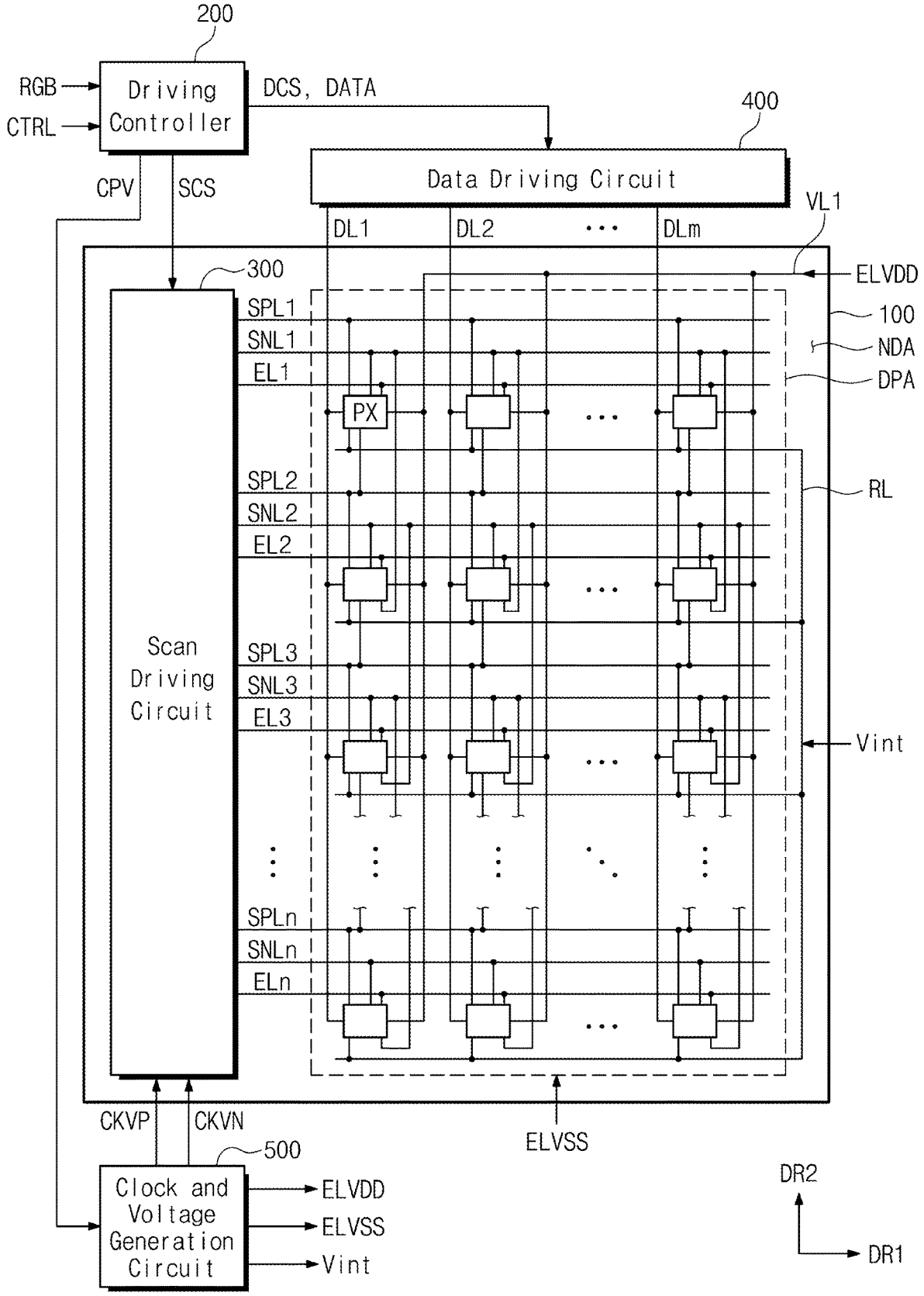
FIG. 1 is a block diagram of an organic light emitting display device according to an exemplary embodiment of the inventive concept.

In the following description, for the purposes of explanation, numerous specific details are set forth in order to provide a thorough understanding of various exemplary embodiments of the invention. As used herein "embodiments" are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

In the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element or a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As is customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a block diagram of an organic light emitting display device according to an exemplary embodiment of the inventive concept.

Referring to FIG. 1, an organic light emitting display device includes a display panel 100, a driving controller 200, a scan driving circuit 300, a data driving circuit 400, and a clock and voltage generation circuit 500.

The driving controller 200 receives an image signal RGB and a control signal CTRL, and converts a data format of the image signal RGB to match interface specifications of the data driving circuit 400 to generate an image data signal DATA. The driving controller 200 outputs a scan control signal SCS, a data control signal DCS, and a gate pulse signal CPV.

The clock and voltage generation circuit 500 receives the gate pulse signal CPV from the driving controller 200, and generates voltages and clock signals necessary for the operation of the organic light emitting display device. In this exemplary embodiment, the clock and voltage generation circuit 500 generates a first driving voltage ELVDD, a second driving voltage ELVSS, an initialization voltage Vint, a first gate clock signal CKVP, and a second gate clock signal CKVN.

The scan driving circuit 300 receives the scan control signal SCS from the driving controller 200, and receives the first gate clock signal CKVP and the second gate clock signal CKVN from the clock and voltage generation circuit 500. The scan control signal SCS may include a start pulse signal initiating the operation of the scan driving circuit 300. The scan driving circuit 300 generates a plurality of scan signals, and outputs the plurality of scan signals sequentially to first type scan lines SPL1-SPLn and second type scan lines signals SNL1-SNLn. Also, the scan driving circuit 300 generates a plurality of light emission control signals EM1-EMn in response to the scan control signal SCS, and outputs the plurality of light emission control signals EM1-EMn to a plurality of control lines EL1-ELn to be described later.

In an exemplary embodiment of the inventive concept, the scan driving circuit 300 may output scan signals to be provided to the first type scan lines SPL1-SPLn in response to the first gate clock signal CKVP, and may output scan signals to be provided to the second type scan lines SNL1-SNLn in response to the second gate clock signal CKVN.

FIG. 1 shows that one scan driving circuit 300 outputs a plurality of scan signals and a plurality of light emission control signals. However, the inventive concept is not limited thereto. In another exemplary embodiment, a plurality of scan driving circuits may divide and output a plurality of scan signals, and may divide and output a plurality of light emission control signals. In addition, in another exemplary embodiment, a driving circuit generating and outputting a plurality of scan signals and a driving circuit generating and outputting a plurality of light emission control signals may be different from each other.

The data driving circuit 400 receives the data control signal DCS and the image data signal DATA from the driving controller 200. The data driving circuit 400 converts the image data signal DATA into data signals and output the data signals to a plurality of data lines DL1-DLm, to be described later. The data signals are analog voltages corresponding to gray scale values of the image data RGB.

The display panel 100 includes the first type scan lines SPL1-SPLn, the second type scan lines SNL1-SNLn, the control lines EL1-ELn, the data lines DL1-DLm, and pixels PX. The first type scan lines SPL1-SPLn and the second type scan lines SNL1-SNLn are extended in a first direction DR1, and arranged spaced apart from each other in a second direction DR2. The data lines DL1-DLm are extended in the second direction DR2, and arranged spaced apart from each other in the first direction DR1.

Each of the plurality of control lines EL1-ELn may be arranged in parallel with a corresponding scan line among the second type scan lines SNL1-SNLn.

Each of the plurality of pixels PX is connected to a corresponding first type scan line among the first type scan lines SPL1-SPLn, a corresponding second type scan line among the second type scan lines SNL1-SNLn, a corresponding control line among the control lines EL1-ELn, and a corresponding data line among the data lines DL1-DLm.

Each of the plurality of pixels PX receives the first driving voltage ELVDD and the second driving voltage ELVSS lower than the first driving voltage ELVDD. Each of the pixels PX is connected to a first driving voltage lines VL1 to which the first driving voltage ELVDD is applied. Each of the pixels PX is connected to an initialization voltage line RL receiving the initialization voltage Vint.

Each of the plurality of pixels PX may be electrically connected to four scan lines. As shown in FIG. 1, pixels in a second pixel row may be connected to scan lines SNL1, SPL2, SNL2, and SPL3.

Each of the plurality of pixels PX includes an light emitting diode (not shown) and a pixel circuit unit, which controls the light emission of the light emitting diode. The pixel circuit unit may include a plurality of transistors and a capacitor. At least any one of the scan driving circuit 300 and the data driving circuit 400 may include transistors formed through the same process as a process for forming the pixel circuit unit.

Through a plurality of photolithography processes, on a base panel (not shown), the first type scan lines SPL1-SPLn, the second type scan lines SNL1-SNLn, the control lines EL1-ELn, the data lines DL1-DLm, the first driving voltage lines VL1, the initialization voltage line RL, the pixels PX, the scan driving circuit 300 and the data driving circuit 400 may be formed. Through a plurality of deposition processes or coating processes, on the base panel (not shown), insulation layers may be formed. Each of the insulation layers may be a thin film covering the entire display panel 100, or may include at least one insulation pattern overlapping a specific component of the display panel 100. The insulation layers include an organic layer and/or an inorganic layer. In addition, an encapsulation layer (not shown) for protecting the pixels PX may be further formed on the base panel.

The display panel 100 receives the first driving voltage ELVDD and the second driving voltage ELVSS. The first driving voltage ELVDD may be provided to the plurality of pixels PX through the first driving voltage line VL1. The second driving voltage ELVSS may be provided to the plurality of pixels PX through electrodes (not shown) formed on the display panel 100 or a power line (not shown).

The display panel 100 received the initialization voltage Vint. The initialization voltage Vint may be provided to the plurality of pixels PX through the initialization voltage line RL.

The display panel 100 may be divided into a display area DPA and a non-display area NDA. The plurality of pixels PX are arranged in the display area DPA. In this exemplary embodiment, the scan driving circuit 300 is arranged in the non-display area NDA which is one side of the display area DPA.

Figure 2:
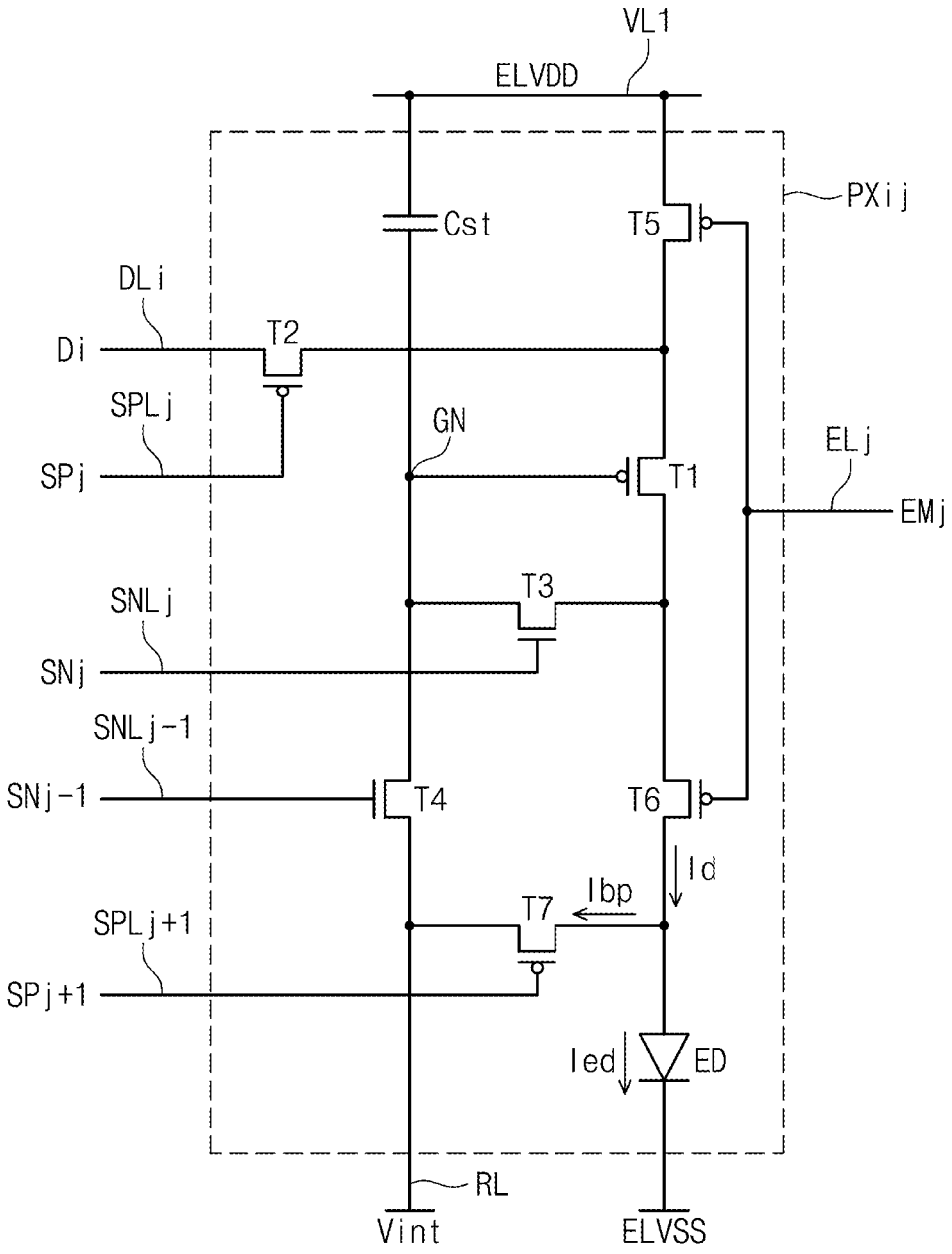
FIG. 2 is an equivalent circuit diagram of a pixel according to an exemplary embodiment of the inventive concept.
Figure 3:
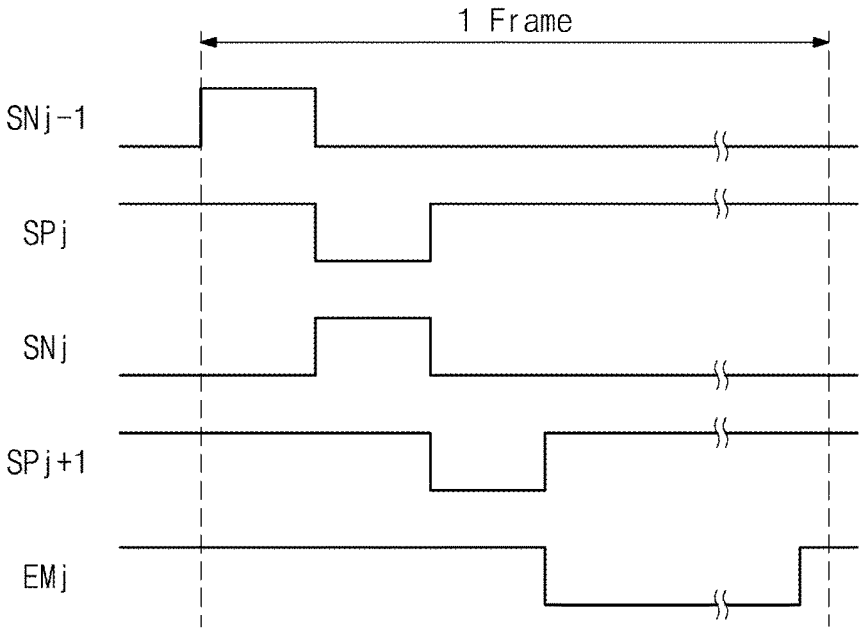
FIG. 3 is a timing diagram for explaining the operation of a pixel of the organic light emitting display device of FIG. 2.

FIG. 2 is an equivalent circuit diagram of a pixel according to an exemplary embodiment of the inventive concept. FIG. 3 is a timing diagram for explaining the operation of a pixel of the organic light emitting display device of FIG. 2.

FIG. 2 exemplarily shows an equivalent circuit diagram of an $i^{th}$ data line DLi among the plurality of data lines DL1-DLm, a j-th first type scan line SPLj and a $j+1^{st}$ first type scan lines SPLj+1 among the plurality of first type scan lines SPL1-SPLn, a j-th second type scan line SNLj and a $j-1^{st}$ second type scan line SNLj−1 among the plurality of second type scan lines SNL1-SNLn, and a j-th control line ELj among the plurality of control lines EL1-ELn. Each of the plurality of pixels PX shown in FIG. 1 may have the same circuit configuration as that shown in the equivalent circuit diagram of a pixel PXij shown in FIG. 2. In this exemplary embodiment, a circuit unit of the pixel PXij includes first to seventh transistors T1-T7 and a capacitor Cst. Also, each of the first, second, fifth, sixth, and seventh transistors T1, T2, T5, T6 and T7 is a P-type transistor having a low-temperature polycrystalline silicon (LTPS) semiconductor layer, and each of the third and fourth transistors T3 and T4 is an N-type transistor having an oxide semiconductor as a semiconductor layer. However, the inventive concept is not limited thereto. At least one of the first to seventh transistors T1-T7 may be an N-type transistor and the rest may be a P-type transistor. Also, the circuit configuration of a pixel according to the inventive concept is not limited to what is shown in FIG. 2. The circuit unit shown in FIG. 2 is only exemplary, and the configuration of the circuit unit may be further modified and executed.

Referring to FIG. 2, the pixel PXij of the display device according to an exemplary embodiment includes the first to seventh transistors T1, T2, T3, T4, T5, T6, and T7, the capacitor Cst, and at least one light emitting diode ED. In this exemplary embodiment, one pixel PXij including one light emitting diode ED will be described as an example.

For convenience of explanation, the j-th first type scan line SPLj, the j-th second type scan line SNLj, the $j-1^{st}$ second type scan line SNLj−1, and $j+1^{st}$ first type scan lines SPLj+1 will be referred to as a first scan line SPLj, a second scan line SNLj, a third scan line SNLj−1, and a fourth scan line SPLj+1.

The first to fourth scan lines SPLj, SNLj, SNLj−1, and SPLj+1 may transmit scan signals SPj, SNj, SNj−1, SPj+1, respectively. The scan signals SPj and Spj+1 may turn on/turn off the second and seventh transistors T2 and T7, which are P-type transistors. The scan signals SNj and SNj−1 may turn on/turn off the third and fourth transistors T3 and T4, which are N-type transistors.

The control line ELj may transmit a light emission control signal EMj for controlling the light emission of the light emitting diode ED included in the pixel PXij. The light emission control signal EMj transmitted by the control line ELj may have a different waveform from the scan signals SPj,SNj, SNj−1 and SPj+1 transmitted by the first to fourth scan lines SPLj, SNLj, SNLj−1, and SPLj+1. The data line DLi transmits a data signal Di, and the first driving voltage line VL1 may transmit the first driving voltage ELVDD. The data signal Di may have different voltage levels depending on the image signal input to the display device, and the first driving voltage ELVDD may have a substantially constant level.

The first transistor T1 includes a first electrode connected to the first driving voltage line VL1 via the fifth transistor T5, a second electrode electrically connected to an anode of the light emitting diode ED via the sixth transistor T6, and a gate electrode connected to one end of the capacitor Cst. The first transistor T1 may receive the data signal Di transmitted by the data Line DLi in accordance with the switching operation of the second transistor T2 and supply a driving current Id to the light emitting diode ED.

The second transistor T2 includes a first electrode connected to the data line DLi, a second electrode connected to the first electrode of the first transistor T1, and a gate electrode connected to the first scan line SPLj. The second transistor T2 may be turned on according to the scan signal SPj received through the first scan line SPLj and transmit the data signal Di transmitted from the data line DLi to a first electrode of the first transistor T1.

The third transistor T3 includes a first electrode connected to the gate electrode of the first transistor T1, a second electrode connected to the second electrode of the first transistor T1, and a gate electrode connected to the second scan line SNLj. The third transistor T3 may be turned on according to the scan signal SNj received through the second scan line SNLj and connect the gate electrode and the second electrode of the first transistor T1 so as to diode connect the first transistor T1.

The fourth transistor T4 includes a first electrode connected to the gate electrode of the first transistor T1, a second electrode connected to initialization voltage line RL through which the initialization voltage Vint is transmitted, and a gate electrode connected to the third scan line SNLj−1. The fourth transistor T4 may be turned on according to the scan signal SNj−1 received through the third scan line SNLj−1 and transmit the initialization voltage Vint to the gate electrode of the first transistor T1 so as to perform an initialization operation for initializing the voltage of the gate electrode of the first transistor T1.

The fifth transistor T5 includes a first electrode connected to the first driving voltage line VL1, a second electrode connected to the first electrode of the first transistor T1, and a gate electrode connected to the j-th control line ELj.

The sixth transistor T6 includes a first electrode connected to second electrode of the first transistor T1, a second electrode connected the anode of the light emitting diode ED, and a gate electrode connected to the j-th control line ELj.

The fifth transistor T5 and the sixth transistor T6 may be simultaneously turned on according to the light emission control signal EMj received through the j-th control line ELj, and through this, the first driving voltage ELVDD may be compensated through the diode-connected first transistor T1 and transmitted to the light emitting diode ED.

The seventh transistor T7 includes a first electrode connected to the second electrode of the fourth transistor T4, a second electrode connected to the second electrode of the sixth transistor T6, and a gate electrode connected to the fourth scan line SPLj+1.

The one end of the capacitor Cst is connected to the gate electrode of the first transistor T1 as described above, and the other end thereof is connected to the first driving voltage line VL1. A cathode of the light emitting diode ED may be connected to a terminal for transmitting the second driving voltage ELVSS. A structure of the pixel PXij according to an embodiment is not limited to the structure shown in FIG. 2. The number of transistors and capacitors included in one pixel PX and the connection relationship thereof may be variously modified.

Referring to FIG. 3 together with FIG. 2 described above, the operation of a display device according to an exemplary embodiment will be described.

Referring FIG. 2 and FIG. 3, during an initialization period within one frame, a high level third scan signal SNj−1 is supplied through the third scan lines SNLj−1. In response to the high level third scan signal SNj−1, the fourth transistor T4 is turned on, and through the fourth transistor T4, the initialization voltage Vint is transmitted to the gate electrode of the first transistor T1 to initialize the first transistor T1.

Next, during data programing and a compensation period, when a low level first scan signal SPj is supplied through the first scan line SPLj, the second transistor T2 is turned on, and at the same time, when a high level scan signal SNj is supplied through the second scan line SNLj, the third transistor T3 is turned on. At this time, the first transistor T1 is diode-connected by the turned on third transistor T3, and is biased in a forward direction. Then, a compensation voltage Di-Vth reduced by a threshold voltage Vth of the first transistor T1 from the data signal Di supplied from the data line DLi is applied to the gate electrode of the first transistor T1. That is, a gate voltage applied to the gate electrode of the first transistor T1 may be the compensation voltage Di-Vth.

To both ends of the capacitor Cst, the first driving voltage ELVDD and the compensation voltage Di-Vth are applied, and in the capacitor Cst, electric charges corresponding to the voltage difference between both ends may be stored.

During a bypass period, the seventh transistor T7 is turned on by being supplied with a low level scan signal SPj+1 through the fourth scan line SPLj+1. A portion of the driving current Id may exit through the seventh transistor T7 as a bypass current Ibp by the seventh transistor T7.

If the light emitting diode ED emits light even when a minimum current of the first transistor T1 for displaying a black image flows into a driving current, the black image is not properly displayed. Accordingly, the seventh transistor T7 of the organic light emitting display device according to an exemplary embodiment of the inventive concept may disperse a portion of the minimum current of the first transistor T1 as a bypass current into a current path other than a current path on the light emitting diode ED side. Here, the minimum current of the first transistor T1 refers to a current under a condition that the first transistor T1 is turned off since a gate-source voltage Vgs of the first transistor T1 is less than the threshold voltage Vth. As such, the minimum driving current under the condition that the first transistor T1 is turned off (for example, a current of 10 pA or less) is transmitted to the light emitting diode ED and displayed as an image of black luminance. When the minimum driving current for displaying the black image flows, the effect of the bypass transmission of the bypass current Ibp is significant. However, when a large driving current for displaying an image, such as a normal image or a white image, flows, there is little effect of the bypass current Ibp. Accordingly, when a driving current for displaying a black image flows, a light emitting current Ied of the light emitting diode ED reduced by the amount of current of the bypass current Ibp exiting through the seventh transistor T7 from the driving current Id may have a minimum amount of current to a level so as to reliably display the black image. Accordingly, an image of correct black luminance may be implemented using the seventh transistor T7, so that the contrast ratio may be improved. In this exemplary embodiment, a bypass signal is the scan signal SPj+1, but is not necessarily limited thereto.

Next, during a light emitting period, the light emission control signal EMj supplied from the j-th control line ELj is changed from a high level to a low level. During the light emitting period, the fifth transistor T5 and the sixth transistor T6 are turned on by a low level light emission control signal EMj. Then, the driving current Id corresponding to the voltage difference between the gate voltage of the gate electrode of the first transistor T1 and the first driving voltage ELVDD is generated, and through the sixth transistor T6, the driving current Id is supplied to the light emitting diode ED such that the light emitting current Ted flows in the light emitting diode ED. During the light emitting period, the gate-source voltage Vgs of the first transistor T1 is maintained as '(Di-Vth)-ELVDD' by the capacitor Cst, and according to the current-voltage relationship of the first transistor T1, the drive current Id may be proportional '$(Di\text{-}ELVDD)^2$' that is square of a value obtained by subtracting the threshold voltage from the gate-source voltage of the first transistor T1.' Accordingly, the driving current Id may be determined regardless of the threshold voltage Vth of the first transistor T1.

Figure 4:
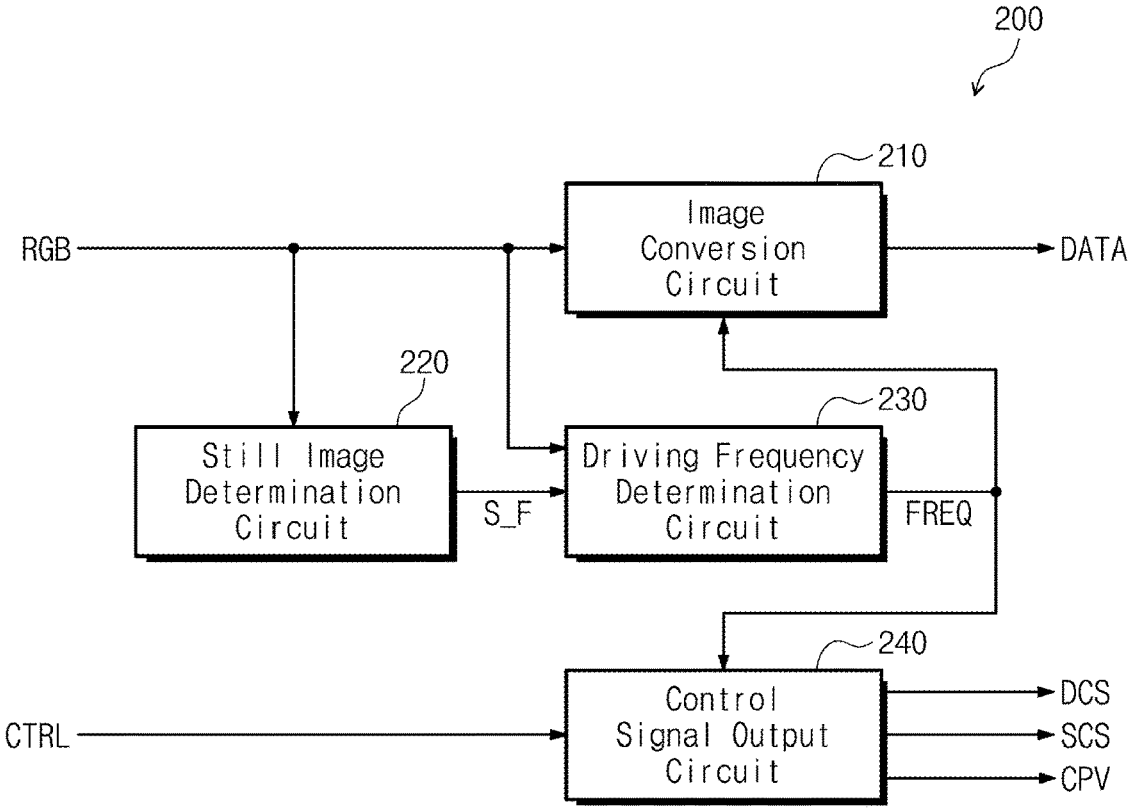
FIG. 4 is a block diagram of a driving controller according to an exemplary embodiment of the inventive concept.

FIG. 4 is a block diagram of a driving controller according to an exemplary embodiment of the inventive concept.

Referring to FIG. 4, the driving controller 200 includes an image conversion circuit 210, a still image determination circuit 220, a driving frequency determination circuit 230, and a control signal output circuit 240.

The image conversion circuit 210 receives the image signals RGB and outputs the image data signal DATA corrected so as to fit the properties of the display panel 100 (see FIG. 1). For example, the image conversion circuit 210 may perform the Adaptive Color Correction (ACC) or the Dynamic Capacitance Compensation (DCC) of the image signal RGB.

The image signal RGB supplied from the outside may include a red image signal, a green image signal and a blue image signal. In an exemplary embodiment of the inventive concept, when the pixels PX provided in the display panel 100 (shown in FIG. 1) include a red pixel, a green pixel, a blue pixel, and a white pixel, the image conversion circuit 210 may convert the image signal RGB to the image data signal DATA including a red data signal, a green data signal, a blue data signal, and a white data signal corresponding to the red pixel, the green pixel, the blue pixel, and the white pixel provided in the display panel 100, respectively.

In another exemplary embodiment, when the pixels PX provided in the display panel 100 (shown in FIG. 1) include a red pixel, a first green pixel, a blue pixel, and a second green pixel, the image conversion circuit 210 may convert the image signal RGB to the image data signal DATA including a red data signal, a first green data signal, a blue data signal, and a second green data signal corresponding to the red pixel, the first green pixel, the blue pixel, and the second green pixel provided in the display panel 100, respectively.

The still image determination circuit 220 may determine whether the image signal RGB in one frame is a still image or a moving image. For example, the still image determination circuit 220 may determine the image signal RGB of a current frame as a still image when the image signal RGB of a previous frame and the image signal RGB of the current frame are the same.

In an exemplary embodiment of the inventive concept, the still image determination circuit 220 may determine the image signal RGB of a current frame as a still image by extracting a representative value for the image signal RGB of one frame using the Linear Feedback Shift Register (LFSR) and comparing a representative value of a previous frame with a representative value of the current frame. Since a still image determination technique using the LFSR does not require a memory, the manufacturing costs of the still image determination circuit 220 may be lowered.

When the image signal RGB of the current frame is determined to be a still image, the still image determination circuit 220 outputs a still image flag signal S_F to a first level (for example, a high level).

When the still image flag signal S_F is the first level, the driving frequency determination circuit 230 determines a driving frequency on the basis of the image signal RGB of the current frame and outputs a driving frequency signal FREQ. The driving frequency signal FREQ is provided to the image conversion circuit 210 and the control signal output circuit 240.

For example, when the still image flag signal S_F is the first level, the driving frequency determination circuit 230 may output the driving frequency signal FREQ according to the properties of the image signal RGB of the current frame. For example, a flicker which may be generated by the image signal RGB of the current frame is predicted, and a driving frequency is determined according to the level of the predicted flicker to output the driving frequency signal FREQ.

For example, when the level of the predicted flicker is low, the driving frequency determination circuit 230 may output the driving frequency signal FREQ corresponding to a driving frequency (for example, any one of 30 Hz, 15 Hz, and 1 Hz) of a level lower than a driving frequency of a normal level (for example, 60 Hz). Also, when the level of the predicted flicker is high, the driving frequency determination circuit 230 may output the driving frequency signal FREQ corresponding to a driving frequency of a normal level (for example, 60 Hz) even when the still image flag signal S_F is the first level. The driving frequency determination circuit 230 may predict the level of a flicker according to a gray scale value of the image signal RGB of the current frame. The driving frequency signal FREQ may be a signal composed of a plurality of bits to represent a plurality of driving frequencies.

When the still image flag signal S_F is a second level, that is, when the image signal RGB of the current frame is not a still image (for example, when the image signal RGB of the current frame is a moving image), the driving frequency determination circuit 230 outputs the driving frequency signal FREQ corresponding to a driving frequency of a normal level (for example, 60 Hz). The specific configuration and operation of the driving frequency determination circuit 230 will be described below in detail.

The image conversion circuit 210 may change the output frequency of the image data signal DATA in response to the driving frequency signal FREQ.

The control signal output circuit 240 outputs the scan control signal SCS, the data control signal DCS, and the gate pulse signal CPV in response to the control signal CTRL and the driving frequency signal FREQ provided from the outside.

Figure 5:
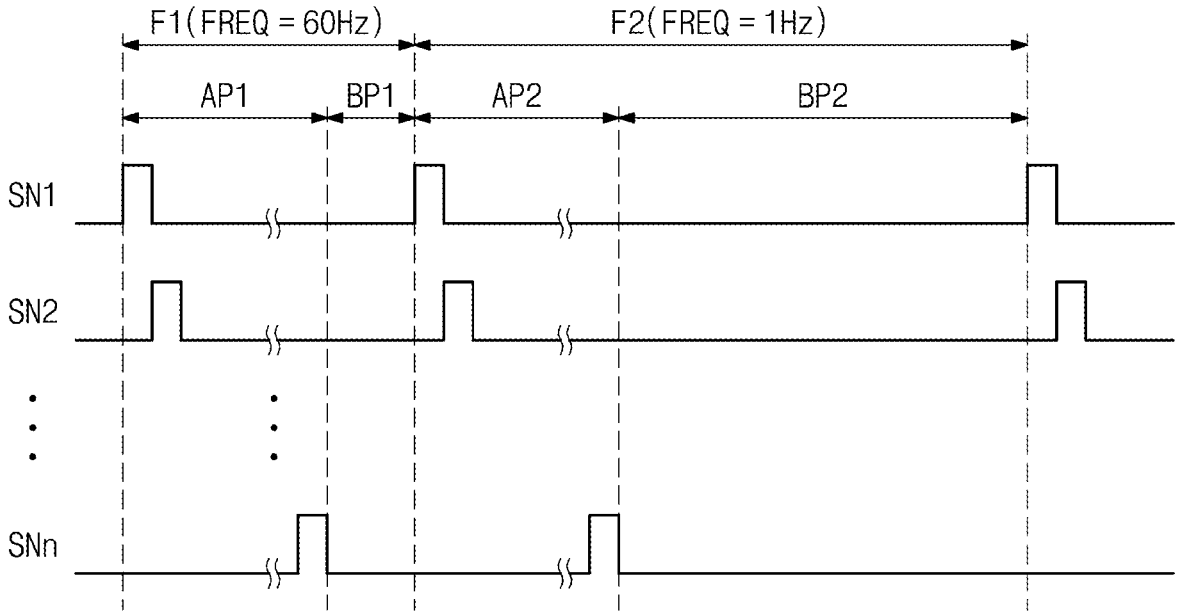
FIG. 5 is a view showing scan signals according to a driving frequency determined by a driving frequency determination circuit according to an exemplary embodiment of the inventive concept.

FIG. 5 is a view showing scan signals according to a driving frequency determined by a driving frequency determination circuit according to an exemplary embodiment of the inventive concept.

Referring to FIG. 1, FIG. 4, and FIG. 5, the scan signals SN1-SNn supplied to the second type scan lines SNL1-SNLn during one frame are sequentially activated to a high level. One frame includes an active period AP in which the scan signals SN1-SNn are sequentially activated to a high level and a blank period BP in which the scan signals SN1-SNn are all maintained at a low level.

In an active period AP1 of a first frame F1 in which the driving frequency signal FREQ corresponds to a driving frequency of 60 Hz, the scan signals SN1-SNn may be sequentially activated to a high level.

In an active period AP2 of a second frame F2 in which the driving frequency signal FREQ corresponds to a driving frequency of 1 Hz, the scan signals SN1-SNn may be sequentially activated to a high level.

The active period AP1 of the first frame F1 and the active period AP2 of the second frame F2 may be the same. A blank period BP2 of the second frame F2 is longer than a blank period BP1 of the first frame F1.

For example, when the driving frequency signal FREQ corresponds to 1 Hz, 15 Hz, 30 Hz and 60 Hz, the length of active period in one frame may be all the same unrelated to the driving frequency signal FREQ, but the length of blank period in one frame therein may be different according to the driving frequency signal FREQ. For example, the lower the driving frequency, the longer the blank period.

In an exemplary embodiment of the inventive concept, when the drive frequency signal FREQ corresponds to a frequency of a level lower than a driving frequency of a normal level, the frequency of the scan signals SN1-SNn provided to the second type scan lines SNL1-SNLn is lowered, but the frequency of the scan signals SP1-SPn provided to the first type scan lines SPL1-SPLn and the frequency of the light emitting control signals EM1-EMn may be maintained at a normal level. However, the inventive concept is not limited thereto, and may be changed in various ways. In another exemplary embodiment, the frequency of the scan signals SP1-SPn provided to the first type scan lines SPL1-SPLn and the frequency of the light emitting control signals EM1-EMn may be the same as that of the scan signals SN1-SNn provided to the second type scan lines SNL1-SNLn.

Figure 6:
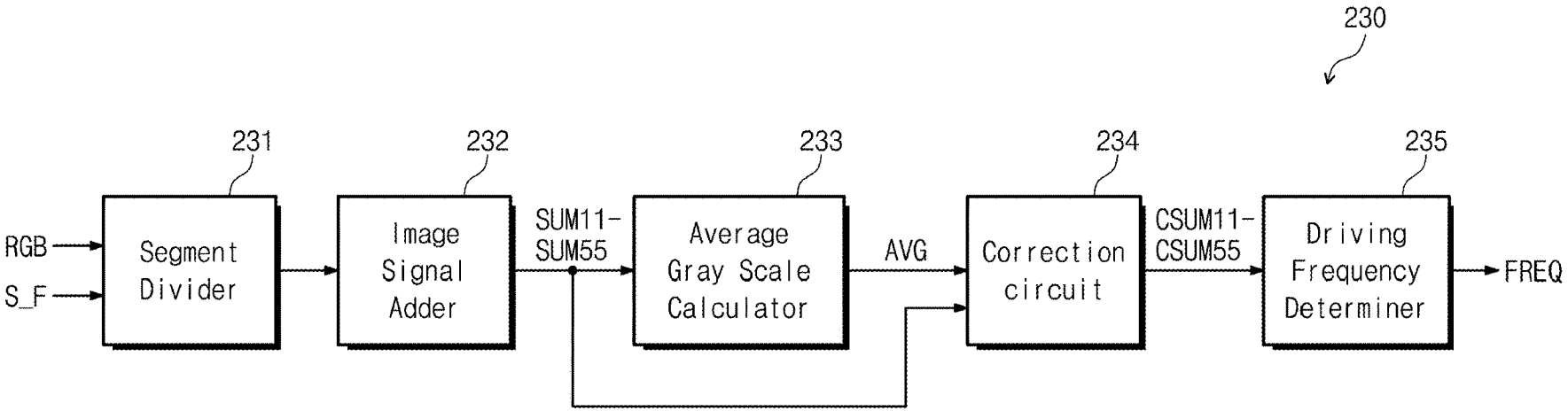
FIG. 6 is a block diagram of a driving frequency determination circuit according to an exemplary embodiment of the inventive concept.
Figure 7:
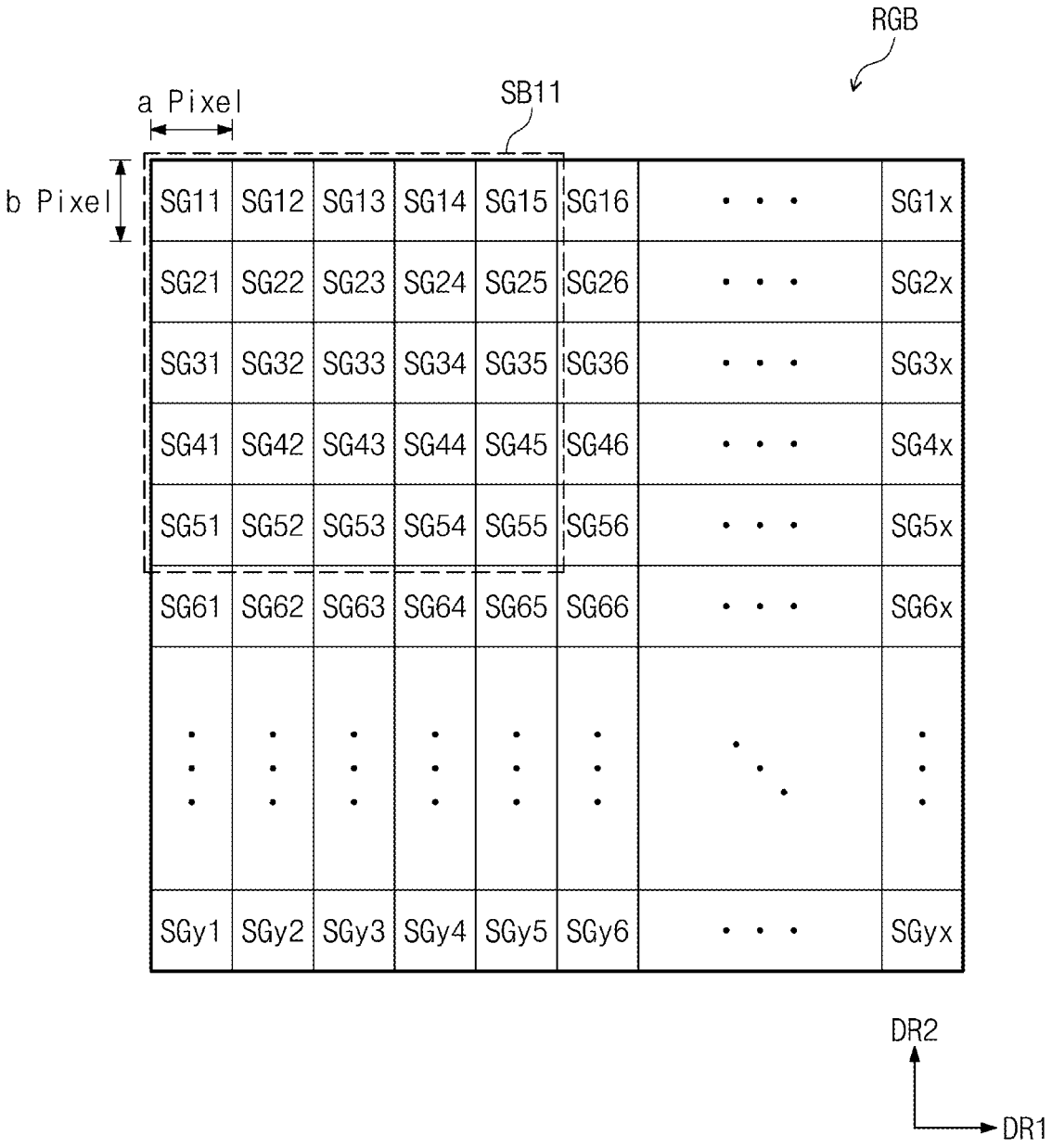
FIG. 7 is a view exemplarily showing dividing an image signal of one frame into a plurality of segments.
Figure 8:
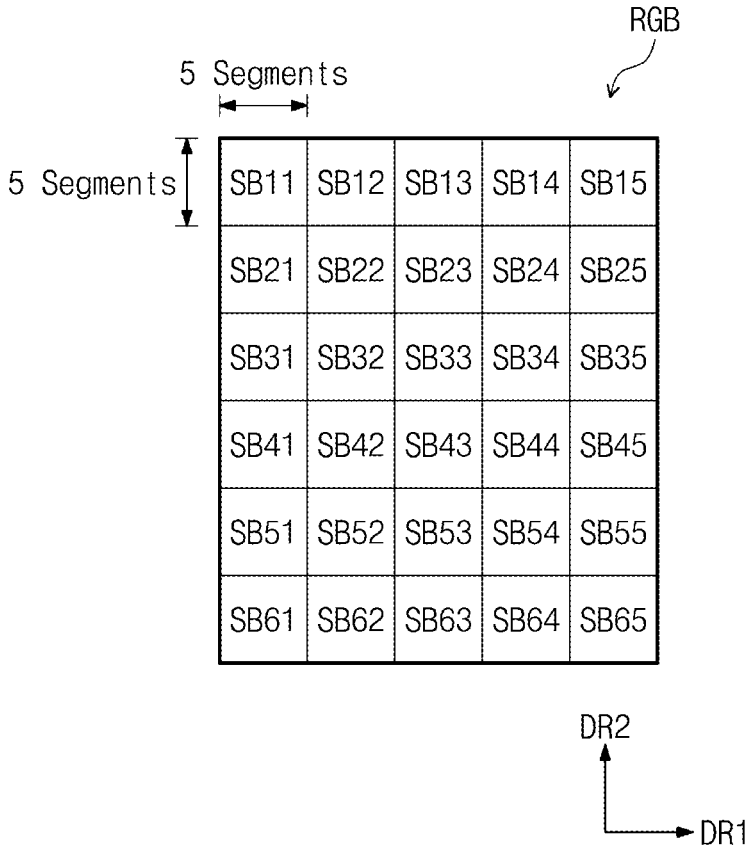
FIG. 8 is a view exemplarily showing dividing an image signal of one frame into a plurality of segment blocks.

FIG. 6 is a block diagram of a driving frequency determination circuit according to an exemplary embodiment of the inventive concept. FIG. 7 is a view exemplarily showing dividing an image signal of one frame into a plurality of segments. FIG. 8 is a view exemplarily showing dividing an image signal of one frame into a plurality of segment blocks.

Referring to FIG. 6, FIG. 7, and FIG. 8, the driving frequency determination circuit 230 includes a segment divider 231, an image signal adder 232, an average gray scale calculator 233, a correction circuit 234, and a driving frequency determiner 235.

The segment divider 231 divides the image signal RGB of one frame into a plurality of segments SG11-SGyx when the still image flag signal S_F is the first level. In this embodiment, the segments SG11-SGyx include x number of segments in the first direction DR1 and y number of segments in the second direction DR2, that is x*y number of segments SG11-SGyx (here, x and y are each a natural number). Each of the segments SG11-SGyx includes an image signal corresponding to "a" number of pixels in the first direction DR1 and "b" number of pixels in the second direction DR2, that is "a"*"b" number of pixels (here, "a" and "b" are each a natural number). For example, "a" and "b" may each be 128. The number of the segments SG11-SGyx may vary depending on the number of the pixels PX provided in the display panel 100 and the size of the segments SG11-SGyx.

The segment divider 231 may define a predetermined number of adjacent segments among the plurality of segments SG11-SGyx as a segment block. For example, one segment block may include 5 segments in the first direction DR1 and 5 segments in the second direction DR2, that is, 25 segments. For example, a segment block SB11 includes 25 segments SG11-SG55 and a segment block SB12 includes 25 segments SG16-SG510. The number of segments includes in one segment block may be changed in various ways. For example, one segment block may include 6 segments in the first direction DR1 and 3 segments in the second direction DR2 (6*3 segments). In the exemplary embodiment shown in FIG. 8, the image signal RGB of one frame may be divided into 5 segment blocks in the first direction DR1 and 6 segment blocks in the second direction DR2 (5*6 segment blocks SB11-SB65).

The image signal adder 232 adds up a gray scale value of each of an image signal of each of 25 segments in one segment block and outputs added-up gray scale values SUM11-SUM55. For example, an added-up gray scale value SUM11 is a value obtained by adding gray scale values of image signals corresponding to 128*128 pixels of a segment SG11 in a segment block SB11. An added-up gray scale value SUM12 is a value obtained by adding gray scale values of image signals corresponding to 128*128 pixels of a segment SG12 in a segment block SB11.

For the convenience of explanation, the image signal adder 232 is shown and described to output the added-up gray scale values SUM11-SUM55 corresponding to unit of 25 segments.

The average gray scale calculator 233 calculates an average gray scale value of segments in a segment block, and outputs an average gray scale value AVG. For example, the average gray scale value AVG may be an arithmetic average obtained by dividing the added-up gray scale values SUM11-SUM55 by 25. The average gray scale calculator 233 may calculate the average gray scale value AVG of each of the segment blocks SB11-SB65 shown in FIG. 8.

The correction circuit 234 adds a weight value to each of the added-up gray scale values SUM11-SUM55 on the basis of the average gray scale value AVG, and outputs corrected added-up gray scale values CSUM11-CSUM55.

The correction circuit 234 may output the corrected added-up gray scale values CSUM11-CSUM55 corrected by adding a weight value $\alpha$ corresponding to a difference between each of the added-up gray scale values SUM11-SUM55 and the average gray scale value AVG to the added-up gray scale values SUM11-SUM55. For example, CSUM11=SUM11+$\alpha$.

The correction circuit 234 may set the weight value $\alpha$ such that the corrected added-up gray scale value CSUM11 becomes greater when the added-up gray scale value SUM11 is less than the average gray scale value AVG. For example, when the added-up gray scale value SUM11 is less than the average gray scale value AVG, the weight value $\alpha$ may be proportional to a difference between the average gray scale value AVG and the added-up gray scale value SUM11. The correction circuit 234 may set the weight value $\alpha$ for the added-up gray scale value SUM11 greater than the average gray scale value AVG to 0. However, the inventive concept is not limited thereto.

The driving frequency determiner 235 determines a driving frequency on the basis of the corrected added-up gray scale values CSUM11-CSUM55, and output the driving frequency signal FREQ.

Figure 9:
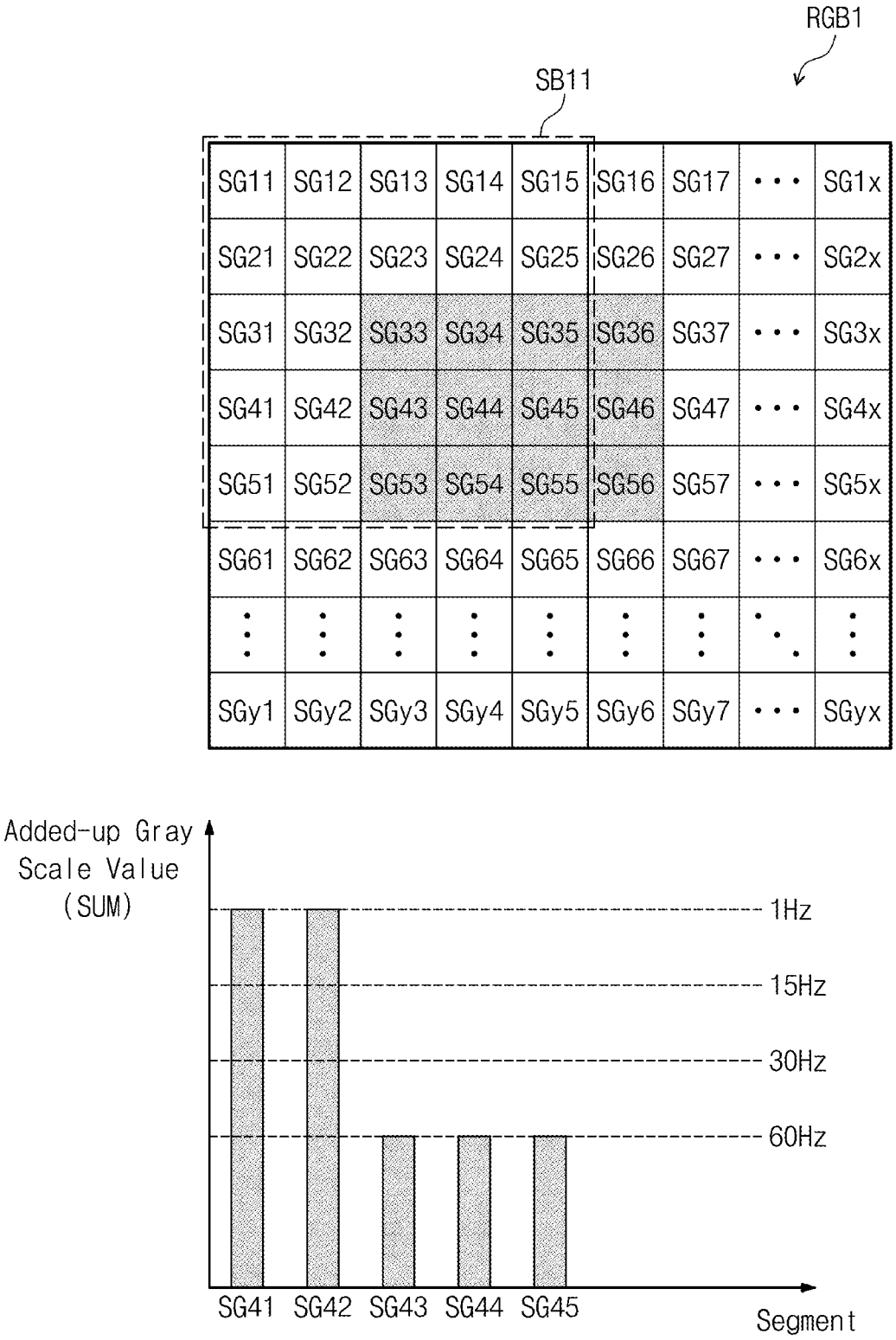
FIG. 9 and FIG. 10 are views exemplarily showing an image signal of one frame.
Figure 10:
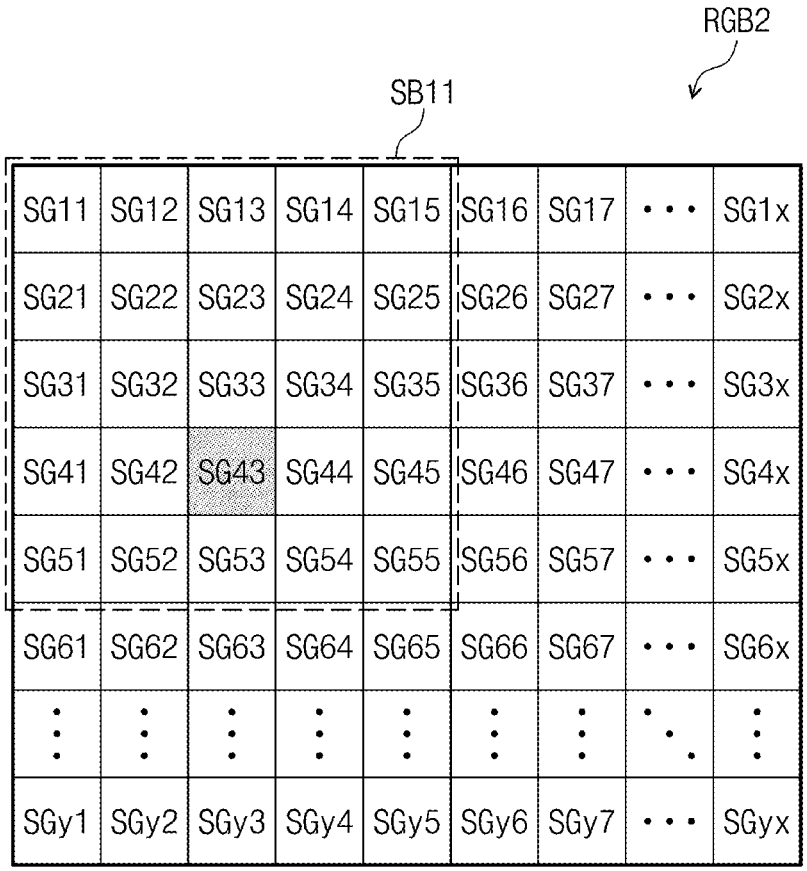
Figure 10:
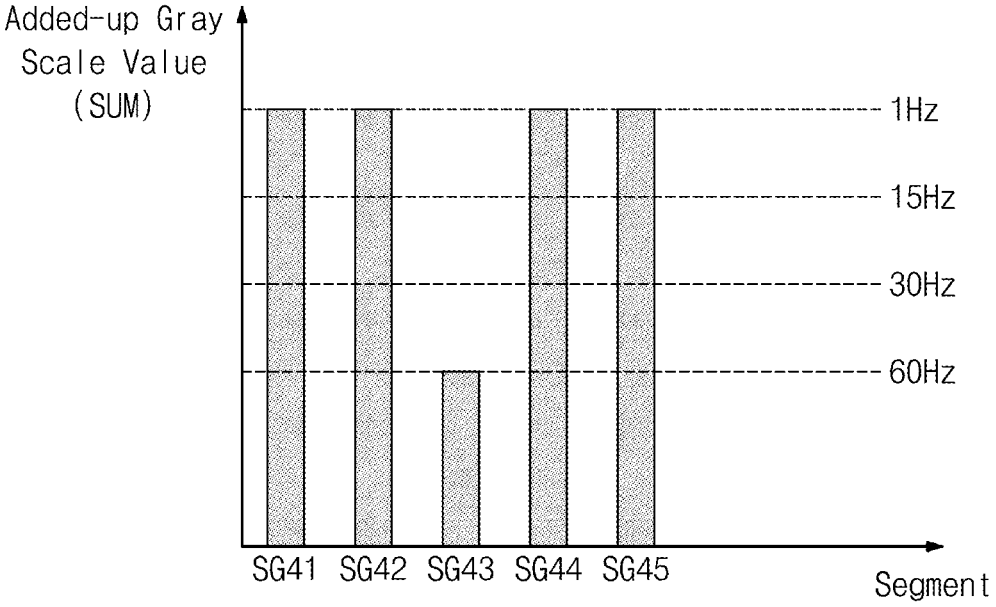

FIG. 9 and FIG. 10 are views exemplarily showing an image signal of one frame. FIG. 9 and FIG. 10 exemplarily shows a case of determining a drive frequency by using only added-up gray scale value of each of segments of an image signal of one frame.

First, referring to FIG. 9, the image signal RGB of one frame may be a first image signal RGB1. For example, when segments SG11-SG15, SG21-SG25, SG31, SG32, SG41, SG42, SG51, and SG52 in the segment block SB11 of the first image signal RGB1 correspond to a white gray scale, an added-up gray scale value may have a higher gray scale level. Also, when segments G33-SG35, SG43-SG35, and SG53-SG55 in the segment block SB11 correspond to a black gray scale, the added-up gray scale value may have a lower gray scale level.

In general, when an image of a low gray scale (for example, a black gray scale) is displayed on the pixels PX (see FIG. 1), the lower the drive frequency, the better the flicker phenomenon is visually recognized. Therefore, in order to minimize flickers, the higher the added-up gray scale value of a segment, the lower the driving frequency may be set, and the lower the added-up gray scale value of a segment, the higher the driving frequency may be set.

In an example shown in FIG. 9, the driving frequency of segments SG41 and SG42, which have high added-up gray scale values, may be determined to be 1 Hz. However, the driving frequency of segments SG43, SG44, and SG45, which have low added-up gray scale values, may be determined to be 60 Hz.

Also, in order to minimize flickers, it is appropriate to set the highest driving frequency among driving frequencies corresponding to the segments SG11-SGyx of the first image signals RGB1 to the driving frequency for the first image signal RGB1.

In an example shown in FIG. 9, the highest driving frequency among driving frequencies corresponding to segments in the segment block SB11 is 60 Hz, so that the driving frequency of the first image signal RGB1 is set to 60 Hz. In this case, even when the first image signal RGB1 is a still image, the driving frequency thereof is set to 60 Hz, which is a normal level driving frequency, so that there is no reduction in power consumption.

Referring to FIG. 10, the image signal RGB of one frame may be a second image signal RGB2. For example, only a segment SG43 in the segment block SB11 corresponds to a black gray scale, and the remaining segments SG11-SG15, SG21-SG25, SG311-SG35, SG41-SG42, SG44-SG45, and SG51-SG55 correspond to a white gray scale. In this case, the driving frequency of segments SG11-SG15, SG21-SG25, SG31-SG35, SG41-SG42, SG44-SG45, and SG51-SG55, which have high added-up gray scale values, may be determined to be 1 Hz. However, the driving frequency of the segment SG43, which has a low added-up gray scale value, may be determined to be 60 Hz.

In an example shown in FIG. 10, the highest driving frequency among driving frequencies corresponding to segments in the segment block SB11 is 60 Hz, so that the driving frequency of the second image signal RGB2 is set to 60 Hz. In this case, even when the second image signal RGB2 is a still image, the driving frequency thereof is set to 60 Hz, which is a normal level driving frequency, so that there is no reduction in power consumption.

Figure 11:
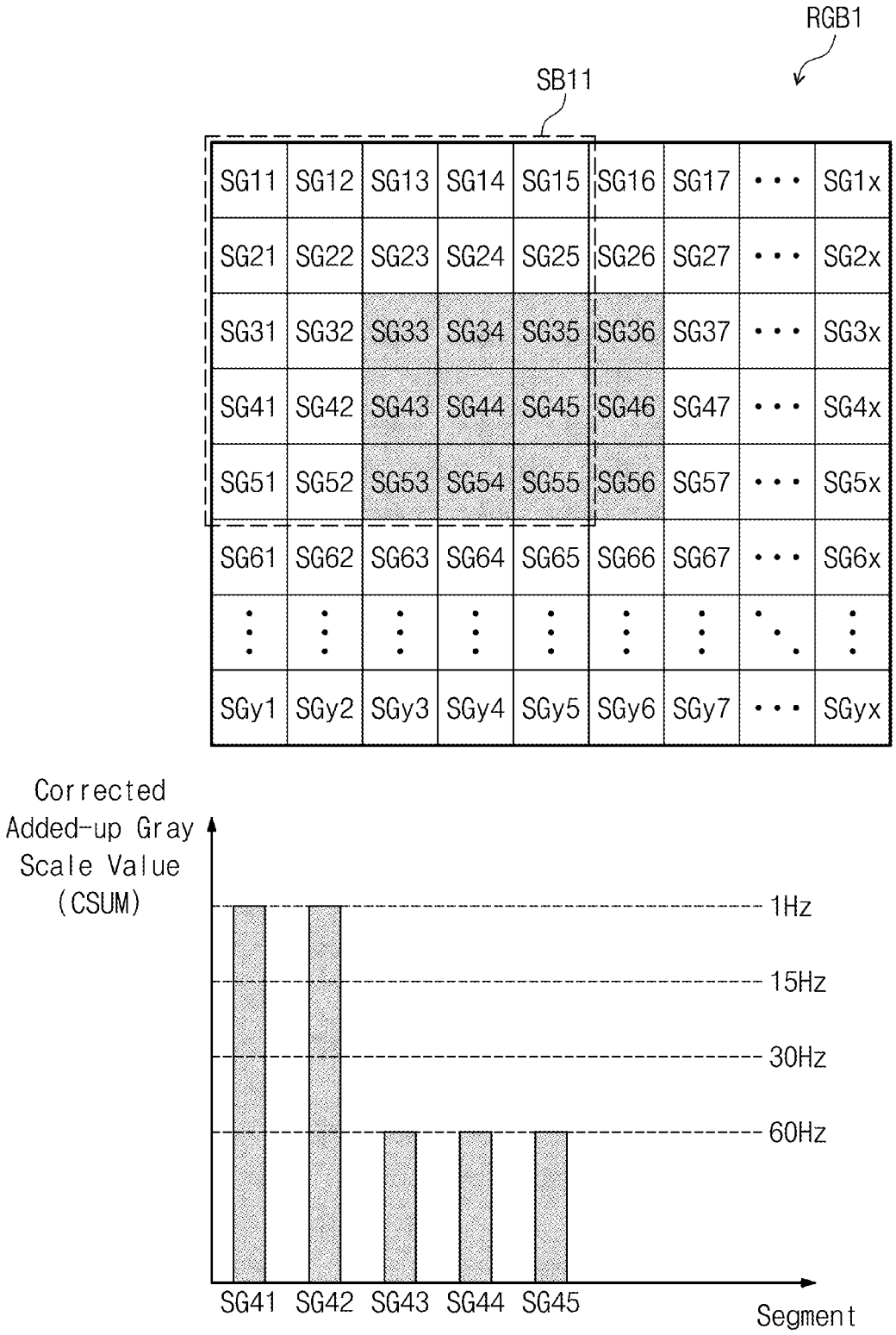
FIG. 11 and FIG. 12 are views exemplarily showing an image signal of one frame.
Figure 12:
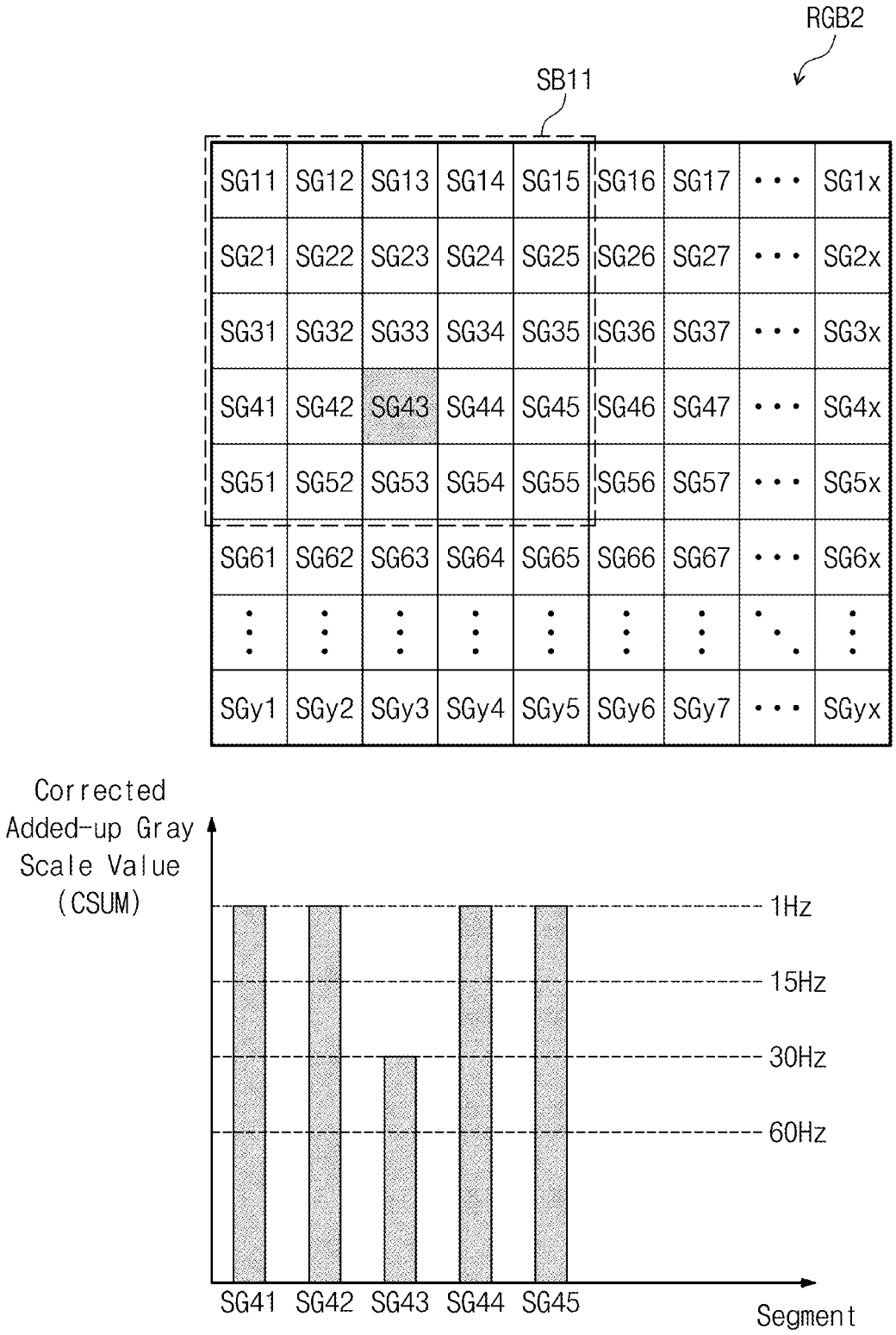

FIG. 11 and FIG. 12 are views exemplarily showing an image signal of one frame. FIG. 11 and FIG. 12 exemplarily shows a case of determining a drive frequency by using an average gray scale value of segments in a segment block of the image signal RGB of one frame. The first image signal RGB1 shown in FIG. 11 and the second image signal RGB2 shown in FIG. 12 are the same as the first image signal RGB1 shown in FIG. 9 and the second image signal RGB2 shown in FIG. 10.

First, referring to FIG. 6 and FIG. 11, the correction circuit 234 adds a weight value to each of the added-up gray scale values SUM11-SUM55 on the basis of the average gray scale value AVG, and outputs the corrected added-up gray scale values CSUM11-CSUM55.

Among 25 segments in the segment block SB11, each of 9 segments SG33-SG35, SG43-SG35, and SG53-SG55 has an added-up gray scale value lower than the average gray scale value AVG. In this case, even when the corrected added-up gray scale values CSUM11-CSUM55 are calculated by adding the weight value $\alpha$ to the added-up gray scale value of each of the 9 segments SG33-SG35, SG43-SG35, and SG53-SG55, the driving frequency of the segments SG43, SG44, SG45 may be determined to be 60 Hz.

Referring to FIG. 6 and FIG. 12, for example, only the segment SG43 in the segment block SB11 corresponds to a black gray scale, and the remaining segments SG11-SG15, SG21-SG25, SG31-SG35, SG41-SG42, SG44-SG45, and SG51-SG55 correspond to a white gray scale. A large number of segments in the segment block SB11 correspond to a white gray scale, so that the average gray scale value AVG of the segment block SB11 calculated by the average gray scale calculator 233 has a high value close to the white gray level.

The correction circuit 234 sets the weight value $\alpha$ such that the corrected added-up gray scale value CSUM43 becomes greater since the added-up gray scale value SUM43 is less than the average gray scale value AVG. Accordingly, the corrected added-up gray scale value CSUM43 for the segment SG43 may be greater than the added-up gray scale value SUM43.

The driving frequency determiner 235 determines a driving frequency on the basis of the corrected added-up gray scale values CSUM11-CSUM55. As the corrected added-up gray scale value CSUM43 for the segment SG43 becomes higher than the added-up gray scale value SUM43, the driving frequency for the segment SG43 may be determined to be 30 Hz. The driving frequency determiner 235 determines the highest driving frequency, which is 30 Hz, among driving frequencies corresponding to segments in the segment block SB11 to be the driving frequency for the segment block SB11. Also, the driving frequency determiner 235 outputs the highest driving frequency among driving frequencies corresponding to each of the segment blocks SB11-SB65 of the second image signal RGB2 as the driving frequency signal FREQ.

As in the case of the first image signal RGB1 shown in FIG. 11, when a black gray scale is arranged in a plurality of adjacent segments, a flicker level may be predicted to be high. In this case, even when the first image signal RGB1 is a still image, the driving frequency thereof may be determined to be a driving frequency of a normal level, or of a high level close to the normal level.

As in the case of the second image signal RGB2 shown in FIG. 12, when a white gray scale is arranged in a plurality of adjacent segments and a black gray scale is arranged in only some segments (for example, one segment SG43), a flicker level may be predicted to be low. In this case, when the first image signal RGB1 is a still image, by setting the driving frequency lower than the normal level, power consumption in a display device may be reduced.

Figure 13:
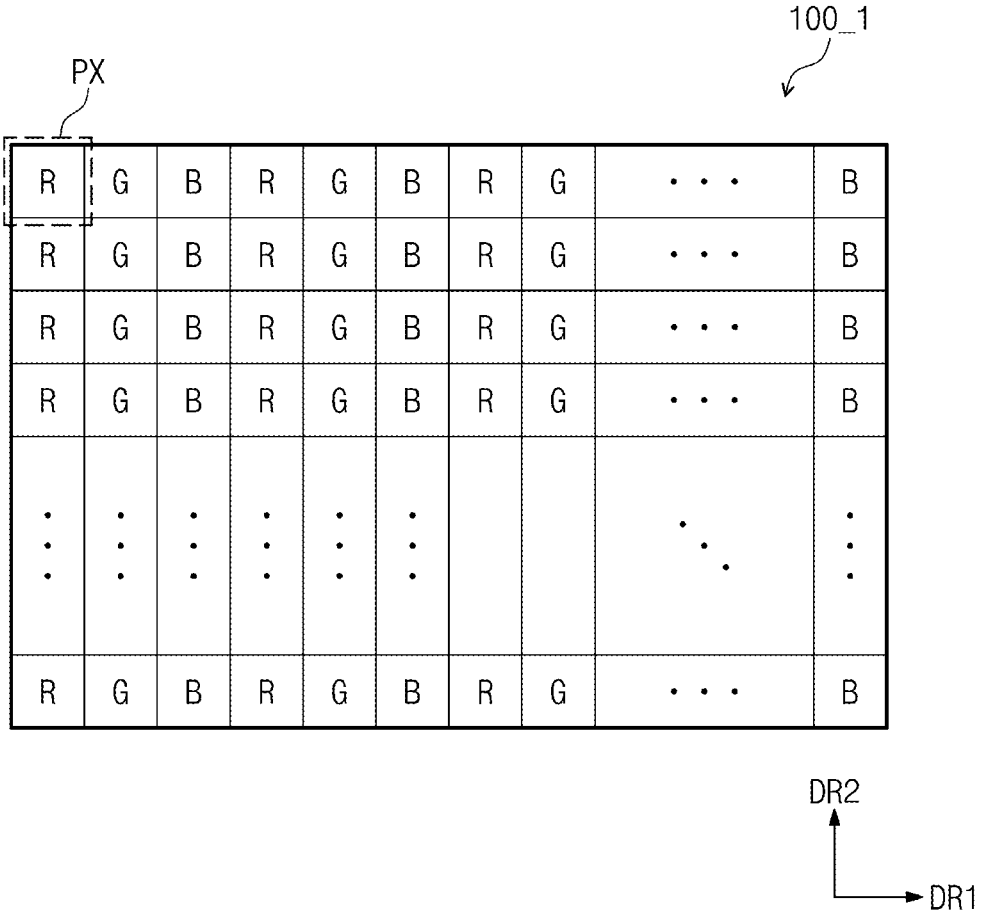
FIG. 13, FIG. 14, and FIG. 15 are views exemplarily showing a pixel array of the display panel of FIG. 1.
Figure 14:
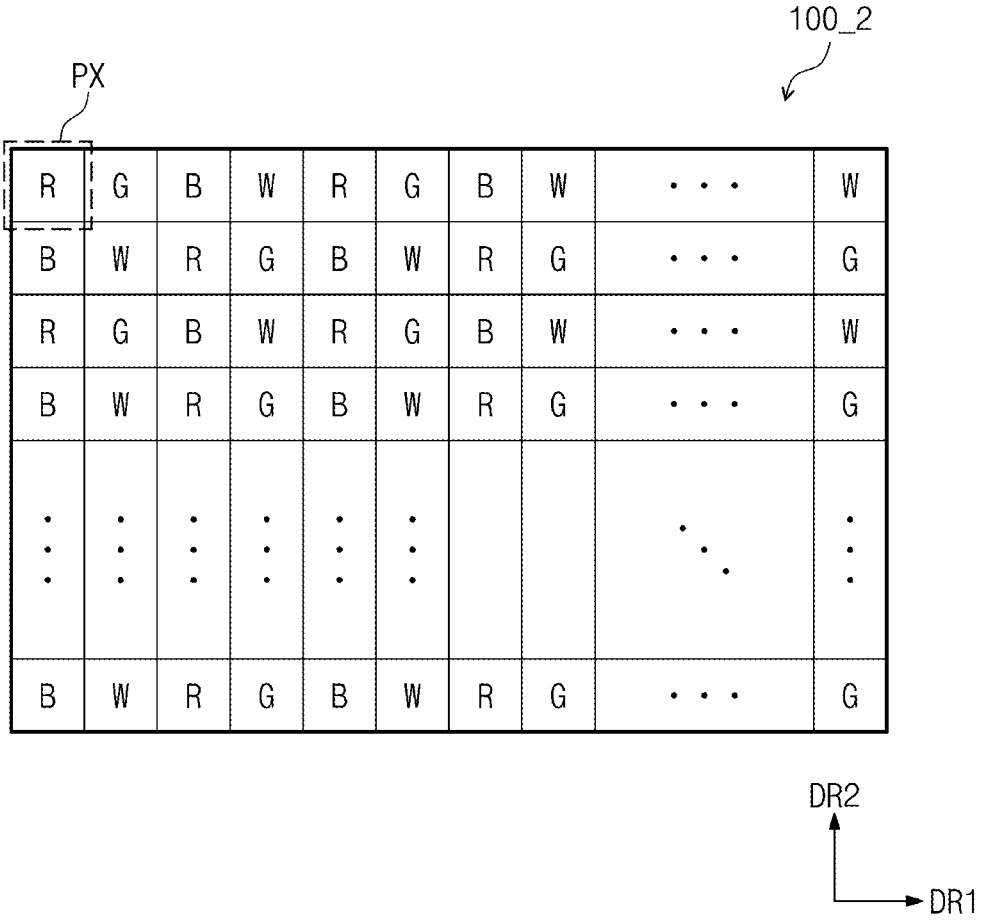
Figure 15:
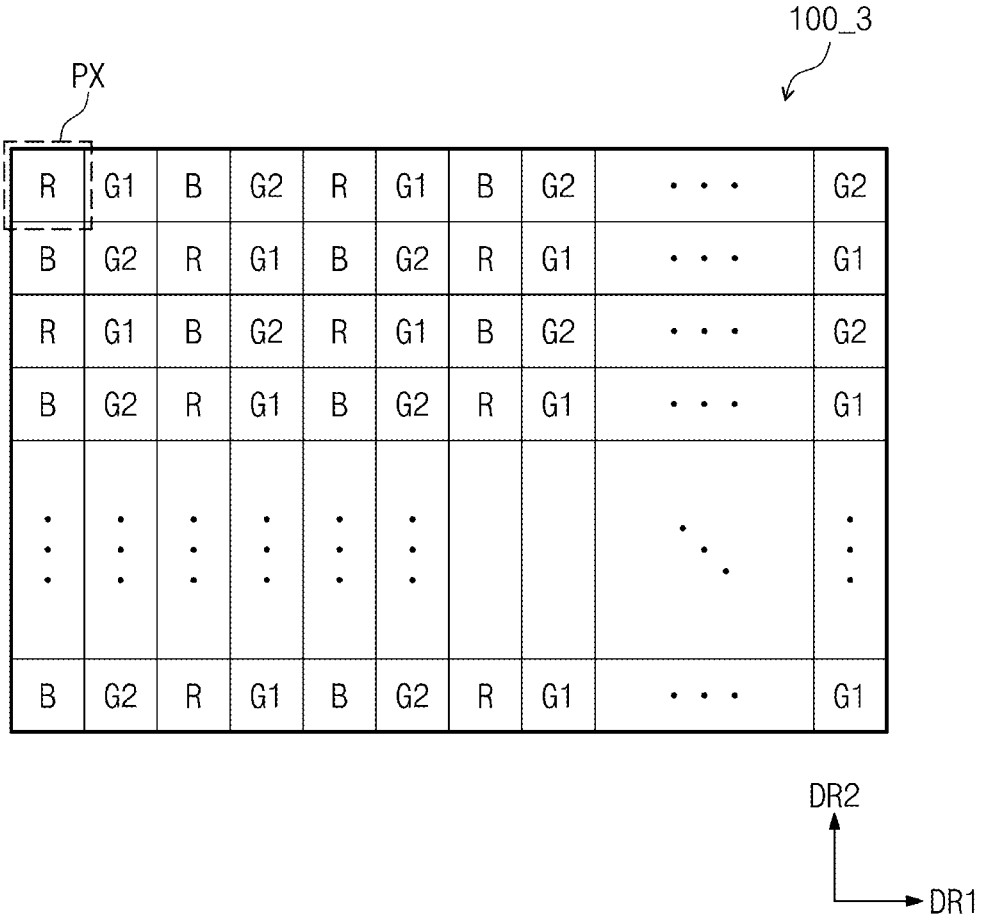

FIGS. 13, 14, and 15 are views exemplarily showing a pixel array of the display panel of FIG. 1.

Referring to FIG. 13, a display panel 100_1 includes the plurality of pixels PX, and each of the plurality of pixels PX may be any one of a red pixel R, a green pixel G, and a blue pixel B.

In FIG. 13, the red pixel R, the green pixel G, and the blue pixel B are shown to be sequentially arranged in the first direction FR1, and pixels having the same color are shown to be arranged in a line in the second direction DR2. However, the array order of the red pixel R, the green pixel G and blue pixel B may be changed in various ways.

Referring to FIG. 14, a display panel 100_2 includes the plurality of pixels PX, and each of the plurality of pixels PX may be any one of the red pixel R, the green pixel G, the blue pixel B, and a white pixel W.

In FIG. 14, the red pixel R, the green pixel G, the blue pixel B, and the white pixel W are shown to be sequentially arranged in the first direction DR1 of odd-numbered rows, and the blue pixel B, the white pixel W, the red pixel R, and the green pixel G are shown to be arranged in the first direction DR1 of even-numbered rows. However, the array order of the red pixel R, the green pixel G, the blue pixel B, and the white pixel W may be changed in various ways.

When the display panel 100 shown in FIG. 1 includes the same pixel arrangement as the display panel 100_2 shown in FIG. 14, the image conversion circuit 210 shown in FIG. 4 may convert the image signal RGB provided from the outside into the image data signal DATA including a red data signal, a green data signal, a blue data signal, and a white data signal corresponding to the red pixel R, the green pixel G, the blue pixel B, and the white pixel W.

Referring to FIG. 15, a display panel 100_2 includes the plurality of pixels PX, and each of the plurality of pixels PX may be any one of the red pixel R, a first green pixel G1, the blue pixel B, and a second green pixel G2.

In FIG. 15, the red pixel R, the first green pixel G1, the blue pixel B, and the second green pixel G2 are shown to be sequentially arranged in the first direction DR1 of odd-numbered rows, and the blue pixel B, the second green pixel G2, the red pixel R, and the first green pixel G1 are shown to be arranged in the first direction DR1 of even-numbered rows. However, the array order of the red pixel R, the first green pixel G1, the blue pixel B, and the second green pixel G2 may be changed in various ways.

When the display panel 100 shown in FIG. 1 includes the same pixel arrangement as the display panel 100_3 shown in FIG. 15, the image conversion circuit 210 shown in FIG. 4 may convert the image signal RGB provided from the outside into the image data signal DATA including a red data signal, a first green data signal, a blue data signal, and a second green data signal corresponding to the red pixel R, the first green pixel G1, the blue pixel B, and the second green pixel G2.

Figure 16:
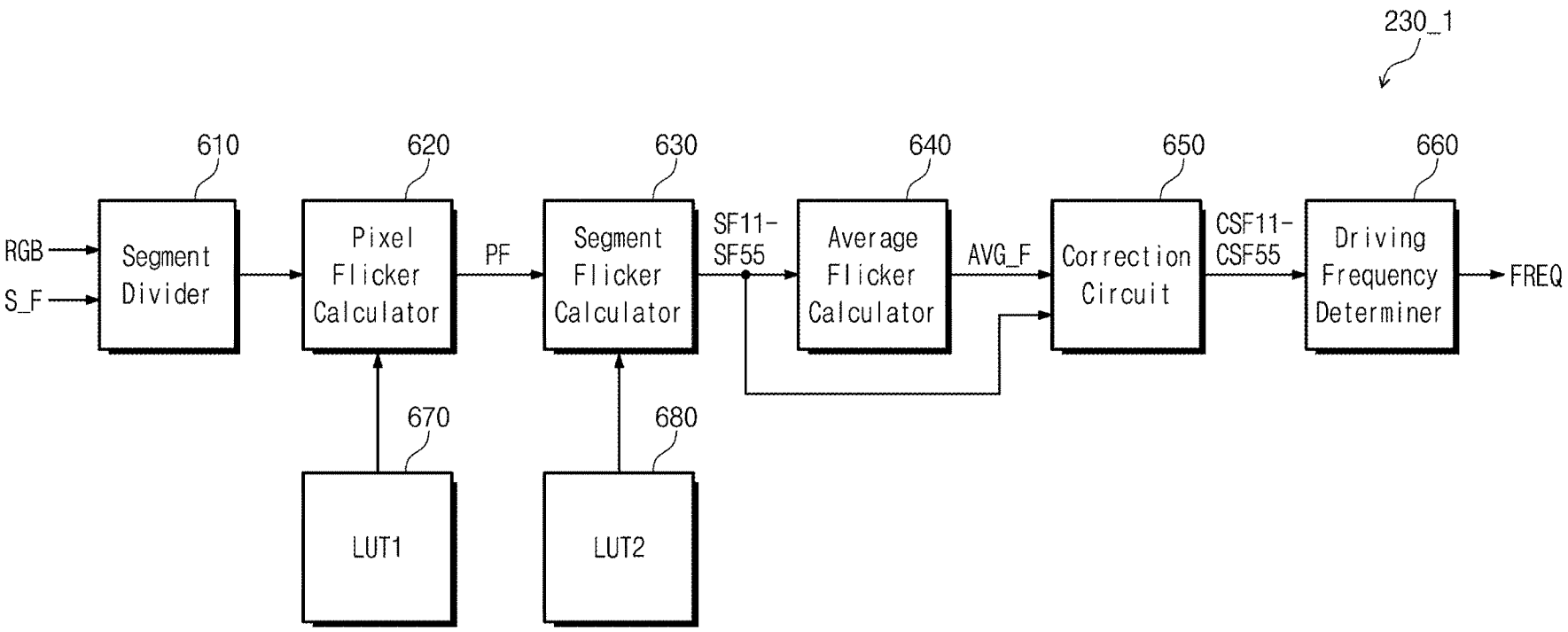
FIG. 16 is a block diagram of a driving frequency determination circuit according to another exemplary embodiment of the inventive concept.

FIG. 16 is a block diagram of a driving frequency determination circuit according to another exemplary embodiment of the inventive concept.

Referring to FIG. 16, a driving frequency determination circuit 230_1 includes a segment divider 610, a pixel flicker calculator 620, a segment flicker calculator 630, an average flicker calculator 640, a correction circuit 650, a driving frequency determiner 660, a first look-up table 670, and a second look-up table 680.

The segment divider 610 divides the image signal RGB of one frame into the plurality of segments SG11-SGyx as shown in FIG. 7, when the still image flag signal S_F is the first level.

The segment divider 610 may define a predetermined number of adjacent segments among the plurality of segments SG11-SGyx as a segment block. For example, the image signal RGB of one frame may be divided into the segment blocks SB11-SB65, as shown in FIG. 8.

The pixel flicker calculator 620 calculates a flicker level of the image signal RGB corresponding to each of the pixels PX (shown in FIG. 1) with reference to the first look-up table 670, and outputs a pixel flicker signal PF. The first look-up table 670 may store a flicker level corresponding to a gray scale value of an image signal.

The segment flicker calculator 630 calculates a flicker for the pixel flicker signals PF of each of 25 segments in one segment block with reference to the second look-up table 680. For example, the segment block SB11 includes the 25 segments SG11-SG55, and the segment flicker calculator 630 outputs segment flicker signals SF11-SF55 corresponding to each of the segments SG11-SG55. For example, when one segment corresponds to 128*128 pixels, the segment flicker calculator 630 may calculate a segment flicker level by adding the pixel flicker signals PF corresponding to the 128*128 pixels. The second look-up table 680 may store a flicker level corresponding to the pixel flicker signals PF.

In an exemplary embodiment of the inventive concept, the pixel flicker calculator 620 and the segment flicker calculator 630 are illustrated and described as a separate circuit block. However, the pixel flicker calculator 620 may be included in the segment flicker calculator 630. For example, the segment flicker calculator 630 may calculate a flicker level for each of the pixels PX in one segment, and then add up the flicker levels to calculate a segment flicker level.

The average flicker calculator 640 calculates an average flicker level of segments in a segment block, and outputs an average flicker signal AVG_F. For example, the average flicker signal AVG_F may be an arithmetic average obtained by dividing the segment flicker signals SF11-SF55 by 25. The average flicker calculator 640 may calculate the average flicker signal AVG_F of each of the segment blocks SB11-SB65 shown in FIG. 8.

The correction circuit 650 adds a weight value to each of the segment flicker signals SF11-SF55 on the basis of the average flicker signal AVG_F, and outputs corrected segment flicker signals CSF11-CSF55.

The correction circuit 650 may output the corrected segment flicker signals CSF11-CSF55 corrected by adding a weight value β corresponding to a difference between each of the segment flicker signals SF11-SF55 and the average flicker signal AVG_F to the segment flicker signals SF11-SF55. For example, CSF11=SF11+β.

The correction circuit 650 may set the weight value β such that a flicker level of the corrected segment flicker signals CSF11-CSF55 becomes lower when the segment flicker signals SF11-SF55 are greater than the average flicker signal AVG_F. For example, when a segment flicker signal SF11 is greater than the average flicker signal AVG_F, the weight value β may be inversely proportional to the difference between the average flicker signal AVG_F and the segment flicker signal SF11. The correction circuit 650 may set the weight value β for the segment flicker signals SF11-SF55 lower than the average flicker signal AVG_F to 0. However, the inventive concept is not limited thereto.

The driving frequency determiner 660 determines a driving frequency on the basis of the corrected segment flicker signals CSF11-CSF55, and output the driving frequency signal FREQ.

Figure 17:
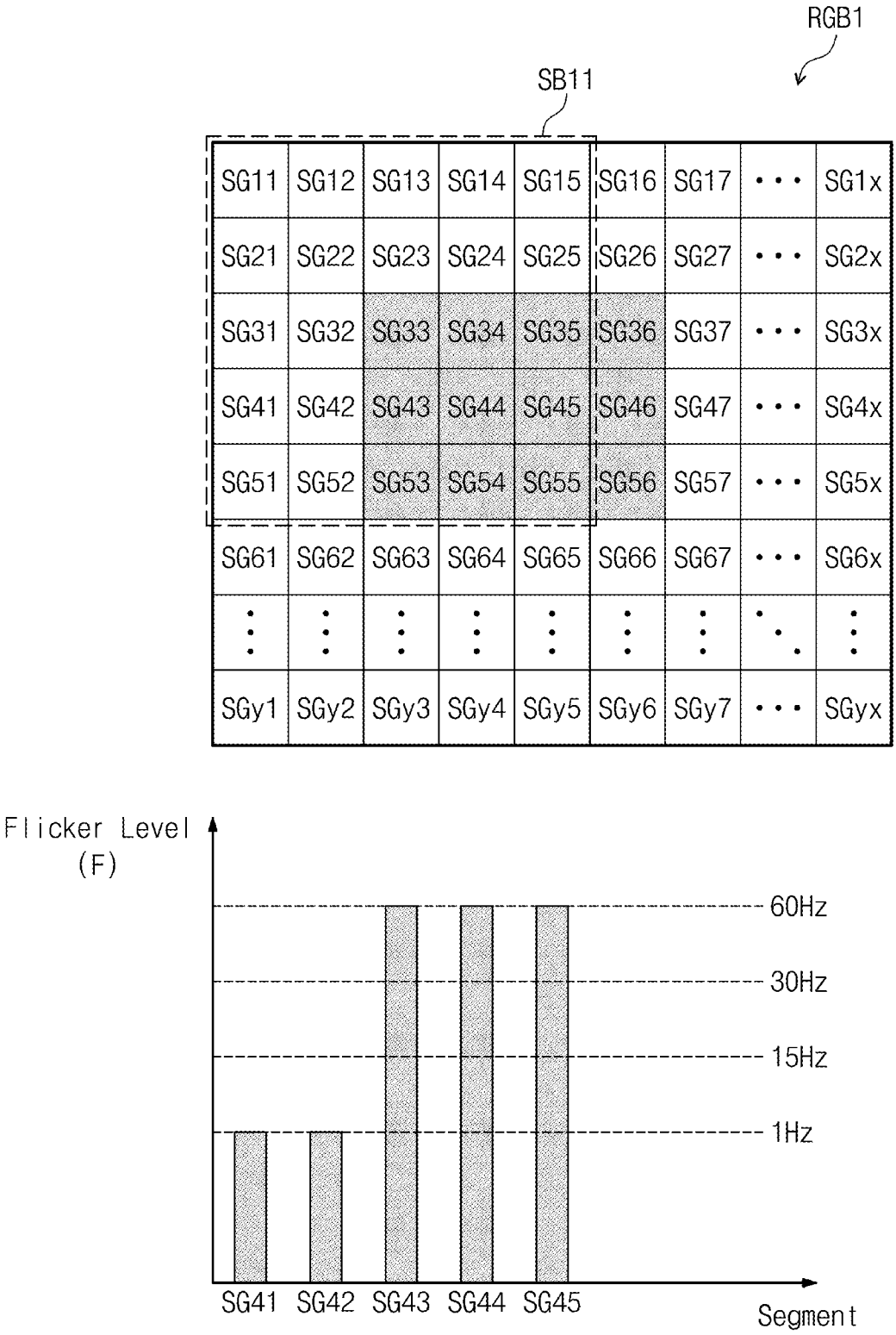
FIG. 17 and FIG. 18 are views exemplarily showing an image signal of one frame.
Figure 18:
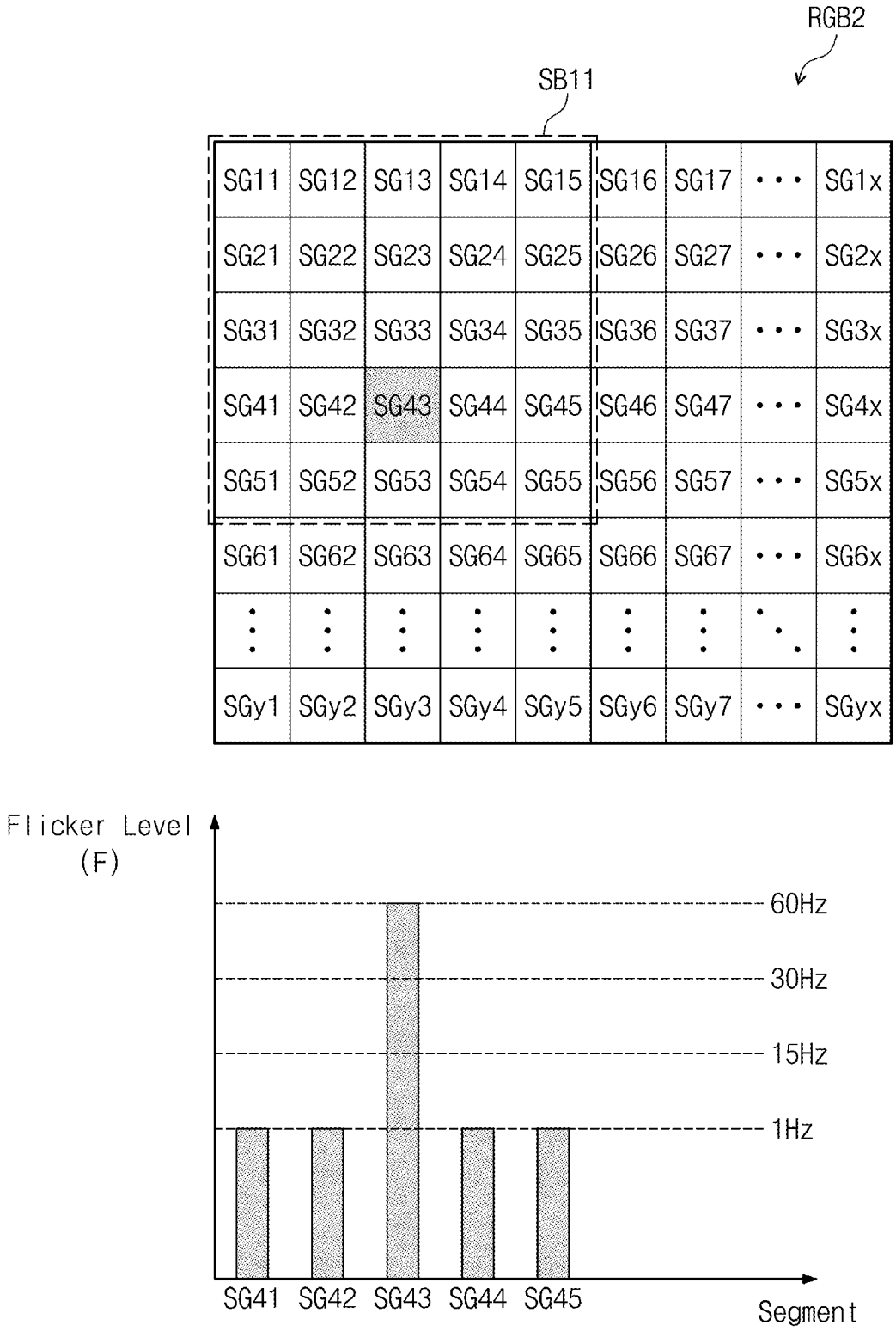

FIG. 17 and FIG. 18 are views exemplarily showing an image signal of one frame. FIG. 17 and FIG. 18 exemplarily show a case of determining a drive frequency by using only segment flicker signals of each of segments of an image signal of one frame.

First, referring to FIG. 17, the image signal RGB of one frame may be the first image signal RGB1. For example, when the segments SG11-SG15, SG21-SG25, SG31, SG32, SG41, SG42, SG51, and SG52 in the segment block SB11 of the first image signal RGB1 correspond to a white gray scale, flicker levels F for the segments SG11-SG15, SG21-SG25, SG31, SG32, SG41, SG42, SG51, and SG52 may be predicted to be low. Also, when the segments SG33-SG35, SG43-SG45, and SG53-SG55 in the segment block SB11 correspond to a black gray scale, flicker levels F for the segments SG33-SG35, SG43-SG45, SG53-SG55 may be expected to be high.

For example, the driving frequency of the segments SG41 and SG42 which have a low flicker level F may be determined to be 1 Hz. However, the driving frequency of the segments SG43, SG44, and SG45 which have a high flicker level F may be determined to be 60 Hz.

Also, in order to minimize flickers, it is appropriate to set the highest driving frequency among driving frequencies corresponding to the segments SG11-SGyx of the first image signals RGB1 to the driving frequency for the first image signal RGB1.

In an example shown in FIG. 17, the highest driving frequency among driving frequencies corresponding to segments in the segment block SB11 is 60 Hz, so that the driving frequency of the first image signal RGB1 is set to 60 Hz. In this case, even when the first image signal RGB1 is a still image, the driving frequency thereof is set to 60 Hz, which is a normal level driving frequency, so that there is no reduction in power consumption.

Referring to FIG. 18, the image signal RGB of one frame may be a second image signal RGB2. For example, only a segment SG43 in the segment block SB11 corresponds to a black gray scale, and the remaining segments SG11-SG15, SG21-SG25, SG31-SG35, SG41-SG42, SG44-SG45, and SG51-SG55 correspond to a white gray scale. In this case, the driving frequency of the segments SG11-SG15, SG21-SG25, SG31-SG35, SG41-SG42, SG44-SG45, and SG51-SG55 which have a low flicker level F may be determined to be 1 Hz. However, the driving frequency of the segment SG43, which has a high flicker level F, may be determined to be 60 Hz.

In an example shown in FIG. 18, the highest driving frequency among driving frequencies corresponding to segments in the segment block SB11 is 60 Hz, so that the driving frequency of the second image signal RGB2 is set to 60 Hz. In this case, even when the second image signal RGB2 is a still image, the driving frequency thereof is set to 60 Hz, which is a normal level driving frequency, so that there is no reduction in power consumption.

Figure 19:
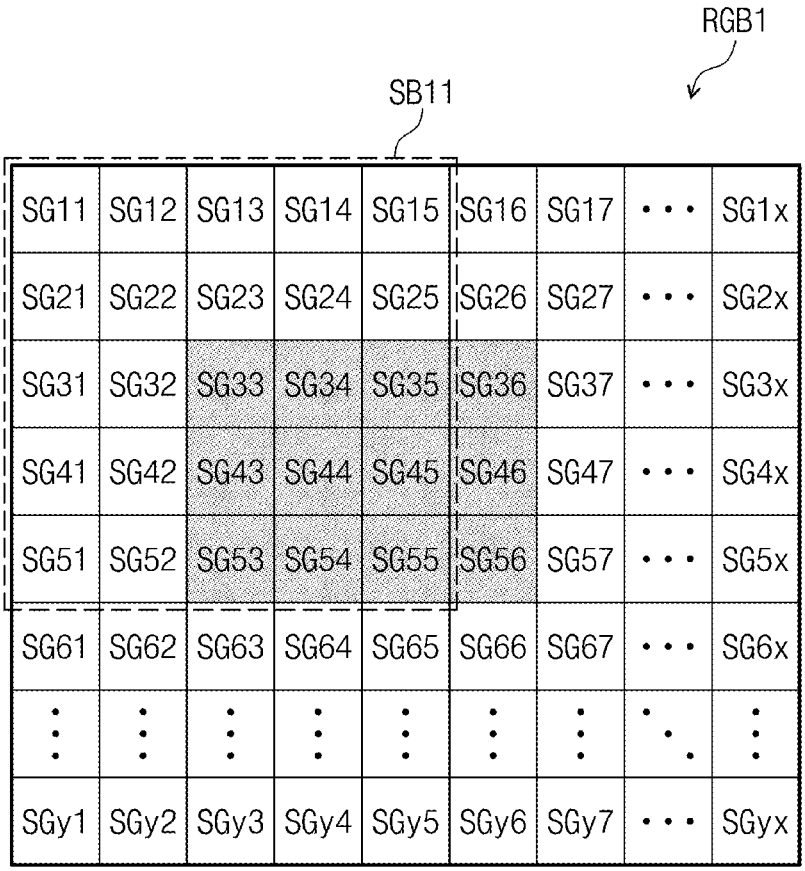
FIG. 19 and FIG. 20 are views exemplarily showing an image signal of one frame.
Figure 19:
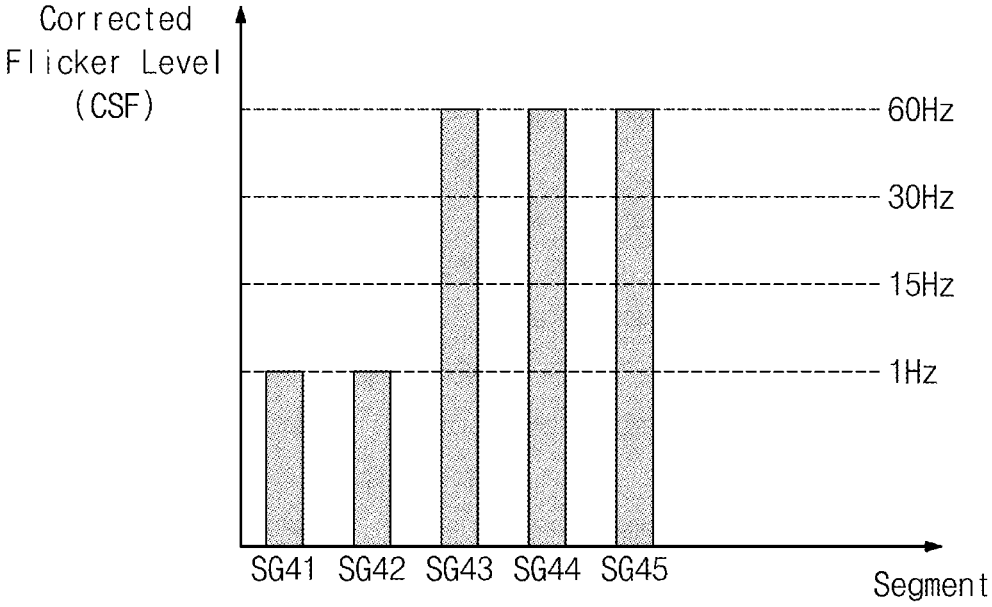
Figure 20:
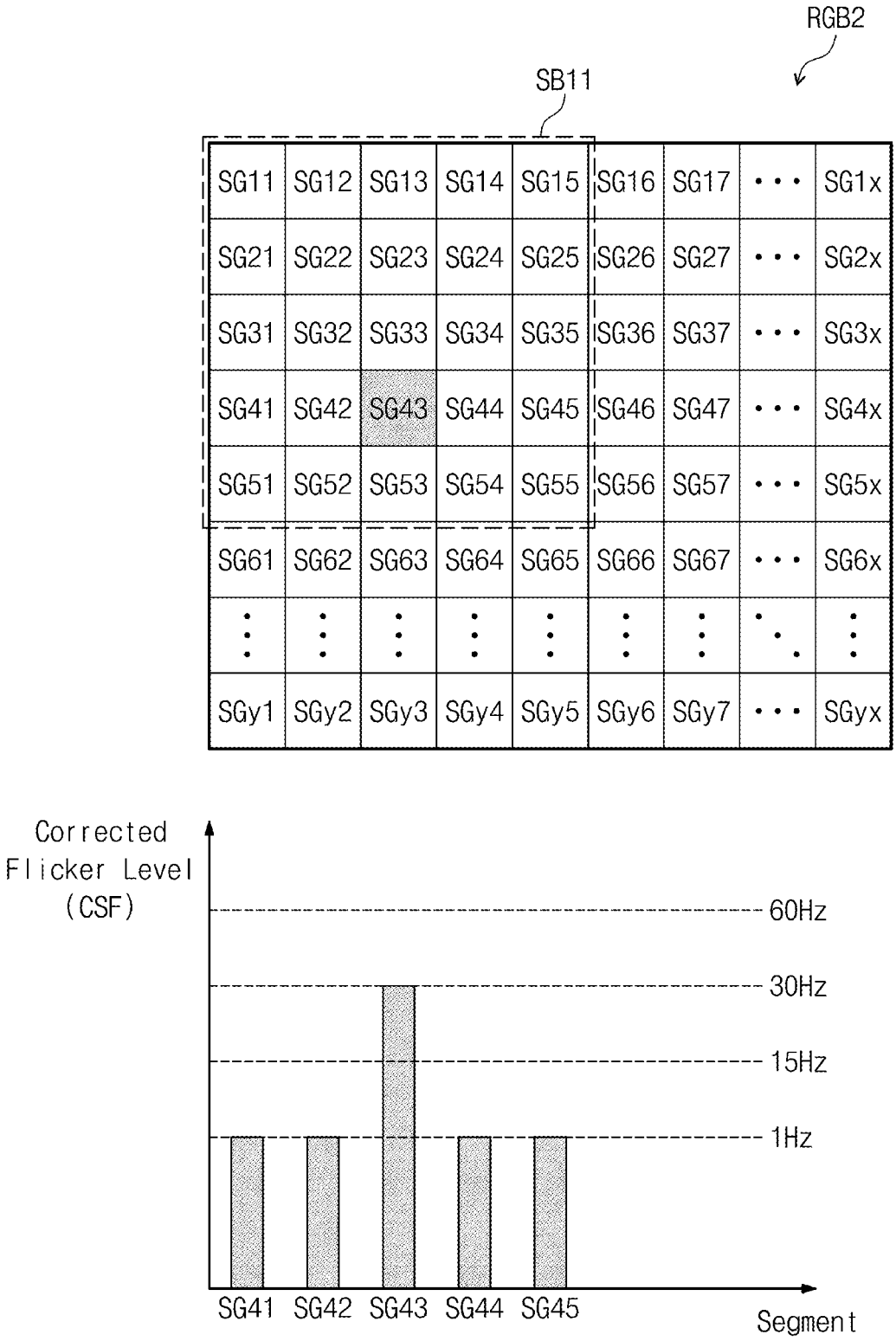

FIG. 19 and FIG. 20 are views exemplarily showing an image signal of one frame. FIG. 19 and FIG. 20 exemplarily shows a case of determining a drive frequency by using a flicker level of segments in a segment block of the image signal RGB of one frame. The first image signal RGB1 shown in FIG. 19 and the second image signal RGB2 shown in FIG. 20 are the same as the first image signal RGB1 shown in FIG. 17 and the second image signal RGB2 shown in FIG. 18.

First, referring to FIG. 16 and FIG. 19, the correction circuit 650 adds a weight value to each of the segment flicker signals SF11-SF55 on the basis of the average flicker signal AVG_F, and outputs the corrected segment flicker signals CSF11-CSF55.

Among 25 segments in the segment block SB11, each of the 9 segments SG33-SG35, SG43-SG45, and SG53-SG55 has a flicker level higher than the average flicker signal AVG_F. In this case, even when the corrected segment flicker signals CSF11-CSF55 are calculated by adding the weight value β to a segment flicker signal of each of the 9 segment blocks SG33-SG35, SG43-SG45, and SG53-SG55, the driving frequency of the segments SG43, SG44, SG45 may be determined to be 60 Hz.

Referring to FIG. 20, for example, only the segment SG43 in the segment block SB11 corresponds to a black gray scale, and the remaining segments SG11-SG15, SG21-SG25, SG311-SG35, SG41-SG42, SG44-SG45, and SG51-SG55 correspond to a white gray scale. In this case, the average flicker signal AVG_F of the segment block SB11 has a low flicker level. Accordingly, a corrected segment flicker signal CSF43 for the segment SG43 may be lower than the segment flicker signal SF43.

The driving frequency determiner 660 determines a driving frequency on the basis of the corrected segment flicker signals CSF11-CSF55. As the corrected segment flicker signal CSF43 for the segment SG43 becomes lower than a segment flicker signal SF43, the driving frequency for the segment SG43 may be determined to be 30 Hz. The driving frequency determiner 660 determines the highest driving frequency, which is 30 Hz, among driving frequencies corresponding to segments in the segment block SB11 to be the driving frequency for the segment block SB11. Also, the driving frequency determiner 660 outputs the highest driving frequency among driving frequencies corresponding to each of the segment blocks SB11-SB65 of the second image signal RGB2 as the driving frequency signal FREQ.

As in the case of the first image signal RGB1 shown in FIG. 19, when a black gray scale is arranged in a plurality of adjacent segments, the average flicker signal AVG_F has a high flicker level. In this case, even when the first image signal RGB1 is a still image, the driving frequency thereof may be determined to be a driving frequency of a normal level, or of a high level close to the normal level.

As in the case of the second image signal RGB2 shown in FIG. 20, when a white gray scale is arranged in a plurality of adjacent segments and a black gray scale is arranged in only some segments (for example, one segment), the average flicker signal AVG_F has a low flicker level. In this case, when the second image signal RGB2 is a still image, by setting the driving frequency lower than the normal level, power consumption in a display device may be reduced.

A driving controller having the above configuration may reduce power consumption by lowering a driving frequency when a still image is input. Particularly, since the driving frequency may be determined according to properties of the still image, power consumption may be efficiently reduced.

Although certain exemplary embodiments have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A driving controller comprising:

a still image determination circuit configured to determinate whether an image signal is a still image; and a driving frequency determination circuit configured to determine a driving frequency when the image signal is the still image, wherein:

the driving frequency determination circuit comprises:

a segment divider configured to divide the image signal into a plurality of segments and define a predetermined number of adjacent segments among the plurality of segments as a segment block;

a segment flicker calculator configured to calculate a flicker level of each of the predetermined number of adjacent segments and output segment flicker signals;

an average flicker calculator configured to receive the segment flicker signals and output an average flicker signal;

a correction circuit configured to output corrected segment flicker signals obtained by adding the weight value to each of the segment flicker signals on the basis of the average flicker signal; and a driving frequency determiner configured to determine the driving frequency on the basis of the corrected segment flicker signals.

2. The driving controller of claim 1, wherein the correction circuit outputs the corrected segment flicker signals obtained by adding the weight value corresponding to a difference between the segment flicker signals and the average flicker signal to the segment flicker signals.

3. The driving controller of claim 2, wherein, the correction circuit sets the weight value such that a flicker level of corresponding to corrected segment flicker signal becomes lower when each of the segment flicker signals is higher than the average flicker signal.

4. The driving controller of claim 1, wherein the driving frequency determiner determines, as the driving frequency, a frequency corresponding to the highest level of corrected segment flicker signal among the corrected segment flicker signals of each of the predetermined number of adjacent segments.

5. The driving controller of claim 1, wherein the driving frequency determiner sets the driving frequency to a normal frequency level when the image signal is not the still image.

6. A display device comprising:

a display panel including a plurality of pixels connected to a plurality of data lines and a plurality of scan lines, respectively;

a driving controller configured to receive an image signal and output an image data signal, a data control signal, and a scan control signal;

a data driving circuit configured to drive the plurality of data lines in response to the image data signal and the data control signal; and a scan driving circuit configured to drive the plurality of scan lines in response to the scan control signal, wherein:

the driving controller comprises:

a still image determination circuit configured to determinate whether the image signal is a still image; and a driving frequency determination circuit configured to determine a driving frequency of the data control signal and the scan control signal when the image signal is the still image; and the driving frequency determination circuit comprises:

a segment divider configured to divide the image signal into a plurality of segments and define a predetermined number of adjacent segments among the plurality of segments as a segment block;

a segment flicker calculator configured to calculate a flicker level of each of the predetermined number of adjacent segments and output segment flicker signals;

an average flicker calculator configured to receive the segment flicker signals and output an average flicker signal;

a correction circuit configured to output corrected segment flicker signals obtained by adding a weight value to each of the segment flicker signals on the basis of the average flicker signal; and a driving frequency determiner configured to determine the driving frequency on the basis of the corrected segment flicker signals.

7. The display device of claim 6, wherein at least one of the plurality of pixels comprises:

a light emitting diode comprising an anode and a cathode;

a first transistor comprising a first electrode electrically connected to a first driving voltage line receiving a first driving voltage, a second electrode electrically connected to the anode of the light emitting diode, and a gate electrode;

a second transistor comprising a first electrode connected to a corresponding data line among the plurality of data lines, a second electrode connected to the first electrode of the first transistor, and a gate electrode connected to a first scan line among the plurality of scan lines; and a third transistor comprising a first electrode connected to the second electrode of the first transistor, a second electrode connected to the gate electrode of the first transistor, and a gate electrode connected to a second scan line among the plurality of scan lines.

8. The display device of claim 7, wherein the first transistor and the second transistor are each a P-type transistor, and the third transistor is an N-type transistor.

9. The display device of claim 7, wherein the first transistor and the second transistor are each a low-temperature polycrystalline silicon (LTPS) semiconductor transistor, and the third transistor is an oxide semiconductor transistor.

10. A method for driving a display device, the method comprising:

determining whether an image signal is a still image;

when the image signal is the still image, dividing the image signal into a plurality of segments and defining a predetermined number of adjacent segments among the plurality of segments as a segment block;

calculating a flicker level of each of the predetermined number of adjacent segments and outputting segment flicker signals;

calculating an average flicker level for the segment flicker signals and outputting an average flicker signal;

outputting corrected segment flicker signals obtained by adding a weight value to each of the segment flicker signals on the basis of the average flicker signal; and determining a driving frequency of the display device on the basis of the corrected segment flicker signals.

11. The method of claim 10, wherein the outputting of the corrected segment flicker signals comprises:

outputting the corrected segment flicker signals obtained by adding the weight value corresponding to a difference between the segment flicker signals and the average flicker signal.

12. The method of claim 10, wherein the outputting of the corrected segment flicker signals comprises:

setting the weight value such that a flicker level of the corrected segment flicker signal becomes lower when the segment flicker signal is higher than the average flicker signal.

* * * * *